US005335486A

United States Patent [19]

Davis

[11] Patent Number: 5,335,486

[45] Date of Patent: Aug. 9, 1994

[54] APPARATUS AND METHOD FOR PRODUCING FLUID-CONTAINING ENVELOPES

[75] Inventor: W. Mark Davis, Lewisville, Colo.

[73] Assignee: Alden Laboratories, Inc., Boulder, Colo.

[21] Appl. No.: 964,453

[22] Filed: Oct. 21, 1992

[51] Int. Cl.[5] ..... B65B 3/02; B65B 3/17; B65B 43/00

[52] U.S. Cl. ..... 53/452; 53/558; 53/374.8

[58] Field of Search ..... 53/452, 453, 455, 558, 53/559, 574, 579, 374.8, 373.7

[56] References Cited

U.S. PATENT DOCUMENTS

| | | | |
|---|---|---|---|
| 2,470,990 | 5/1949 | Kennedy . | |
| 2,962,843 | 12/1960 | Hoelzer et al. . | |
| 2,991,500 | 7/1961 | Hagen . | |
| 3,366,523 | 1/1968 | Weber . | |
| 3,423,902 | 1/1969 | Stroop | 53/559 X |
| 3,575,757 | 4/1971 | Smith . | |
| 3,660,189 | 5/1972 | Troy . | |
| 3,971,192 | 7/1976 | Soukup et al. | 53/559 |
| 3,975,885 | 8/1976 | Carlisle | 53/558 X |
| 4,055,032 | 10/1977 | Hammond . | |
| 4,075,301 | 2/1978 | Oswald . | |
| 4,135,180 | 1/1979 | White . | |
| 4,169,344 | 10/1979 | Ganz et al. . | |
| 4,240,999 | 12/1980 | Decker, Jr. . | |
| 4,704,844 | 11/1987 | Mancini | 53/453 |
| 4,783,298 | 11/1988 | Oda . | |
| 4,793,121 | 12/1988 | Jamison | 53/453 X |
| 4,839,117 | 6/1989 | Swenson et al. . | |
| 4,862,676 | 9/1989 | Mancini | 53/453 |

*Primary Examiner*—Horace M. Culver
*Attorney, Agent, or Firm*—Sheridan Ross & McIntosh

[57] ABSTRACT

An apparatus and method for forming fluid-containing envelopes from two superimposed layers of enclosure material, defining a workpiece, by transporting the workpiece on a support to a plurality of processing stations. One of the processing stations forms at least a portion of the perimeter of each envelope to be formed from the workpiece by appropriately sealing the two layers together in a predefined pattern. At least one inlet coinciding with an unsealed portion of the layers is provided for each such envelope such that an appropriate fluid may be provided thereto when the workpiece is positioned at another processing station. Advantageously, the workpiece is maintained in a certain position on/relative to the support when provided to the envelope filling/forming station and other processing stations which may be incorporated (e.g., secondary sealing station, die cutting station). As a result, the potential for production of defective envelopes which would have to be scrapped is reduced since the alignment of the workpiece relative to such processing stations is maintained within a certain tolerance.

43 Claims, 20 Drawing Sheets

APPARATUS AND METHOD FOR PRODUCING FLUID-CONTAINING ENVELOPES

FIELD OF THE INVENTION

The present invention relates to forming fluid-containing envelopes and, more particularly, to forming such envelopes in a multiple processing station configuration in which at least one section of material is used to provide two superimposed layers and is desirably positioned on/relative to a support for transportation to each such processing station.

BACKGROUND OF THE INVENTION

Envelopes which have a fluid or fluid-like material therein are used for a variety of purposes, one of which is as a padding device for portions of the human anatomy. Particularly in this type of application, the envelope is formed from two layers of substantially flexible material which may be sealed together in a desired shape. However, in order to provide fluid access to the envelope a portion of the perimeter of the envelope remains unsealed such that the fluid may be introduced into the envelope between the two layers. When an appropriate amount of fluid is injected into the envelope, the remainder of the perimeter of the envelope is sealed.

A number of methods which incorporate the above-described types of principles for producing envelopes have been suggested. For instance, "batch"-type processes have been utilized to produce a single envelope. These envelopes are formed either from a single section of material which is appropriately folded to provide two superimposed layers, or from two sections which may be superimposed. Nonetheless, the envelope-forming materials are physically transported, typically by an operator, initially to a first sealing machine to provide a primary definition of the envelope's perimeter and at least one inlet thereto, to a machine for providing fluid to the partially formed envelope, and finally to a second sealing machine to seal off the inlet(s). U.S. Pat. No. 2,470,990 to Kennedy, issued May 24, 1949, discloses one type of "batch" process for simultaneously producing multiple envelopes.

With further regard to Kennedy, generally a heat-sealable sheet of plastic material is folded to provide superimposed layers which are heat sealed together to form a plurality of inflatable articles. These inflatable articles are spaced along both sides of a linear manifold which interconnects such articles and which is also formed by the heat sealing of the superimposed layers. In this configuration, excess material is trimmed and the articles are inflated with a fluid which is introduced at one end of the manifold. When the inlet is thereafter closed, a further heat sealing operation is performed to seal off each of the inflated articles from the manifold such that the inflated articles may be subsequently detached therefrom.

Continuous-type methods are also utilized for producing envelopes generally of the above-described type. More particularly, two continuous sheets of appropriate material are contained on vertically displaced and advancable rolls. The sheets are sealed together, such as by a heat sealing operation, to define a portion of the perimeter of the envelope. An appropriate fluid is then introduced between the sheets by a nozzle which passes between the rolls and thus between the sheets. The sheets are then further sealed to complete the definition of the envelope. In some cases, only a single sealing station is actually utilized such that the second sealing operation for the first envelope being formed actually also provides the initial definition of the second envelope to be formed as well. U.S. Pat. Nos. 3,366,523 to Weber, issued Jan. 30, 1968, 3,575,757 to Smith, issued Apr. 30, 1971, and 4,169,344 to Ganz et al., issued Oct. 2, 1979, are generally representative of dual roll continuous formation processes.

SUMMARY OF THE INVENTION

The present invention is generally an apparatus and method for forming fluid-containing envelopes in a multiple processing station configuration. More particularly, at least one section of material is used to provide two superimposed layers and is desirably positioned on/relative to a support in a fixed orientation for transportation to at least one processing station to allow for formation of at least one envelope therefrom.

Generally, the present invention includes/utilizes a support on which at least one section of material is positioned thereon, directly or indirectly, for transporting the material to a plurality of processing stations for formation of at least one envelope therefrom. More particularly, the at least one section of material forms two at least partially superimposed layers to provide a desired workpiece (e.g., by folding a single section, by using two separate sections and superimposing the same). One of the processing stations at which the support and workpiece are positioned joins/seals such layers together in a predetermined pattern to define at least a portion of the perimeter of each such envelope to be formed from such workpiece. Another of the processing stations at which the support and workpiece are positioned introduces an appropriate fluid/fluid-like material between the layers such that at least a portion of the fluid is retained within each such enclosure. In this regard, an orientation of at least a portion of the workpiece relative to the support is maintained at least when such is transported to the fluid-introduction station. Moreover, the fluid may be introduced between the layers of material by a male fill tool which extends through one of the layers for interconnection with an appropriate source of fluid at such station.

With further regard to the support, in one aspect of the present invention the support is a turret/turntable which may be rotated in predetermined increments to transport and accurately position the workpiece at each of the processing stations. Consequently, a plurality of workpieces may be spaced on the turret/turntable such that one of such workpieces will be positioned at each of the processing stations to enhance production capacity. In another aspect, the support is a pallet which is transported to the various processing stations by a conveyor assembly for desirable positioning of the workpiece at such processing stations.

With further regard to the orientation of the superimposed layers on/relative to the support, in one aspect of the present invention at least a portion of the superimposed layers are maintained in a predetermined position on the support during at least a portion of the formation process. For instance, a buffer material may be positioned between the bottom layer and the support, preferably upon a substantially planar surface of the support in proximity to where the layers are sealed together in the above-described manner. Consequently, when the layers are so sealed together, the bottom layer at least partially and releasably adheres to the buffer material. In one aspect the portions of the layers which are joined together actually define that portion of the bottom layer which adheres to the buffer material in the described manner. Nonetheless, when the envelope(s) is completely formed, it may be removed from the buffer material, for instance at a stripping station.

In further aspects of the present invention, additional processing stations may be incorporated into the assembly of the present invention. For instance, in one aspect the support with the workpiece thereon is transported to a processing station which seals the layers together to close all inlets/vents to the envelope(s). Such inlets and vents may be utilized in the injection of fluid to the envelopes at one of the processing stations. Furthermore, in another aspect the support with the workpiece thereon is transported to a processing station which cuts out each envelope from the workpiece, such as by using an appropriately configured cutting die. In addition, in another aspect the support with the workpiece thereon is transported to a processing station at which the envelopes may be removed from the support, such as the above-described removal of the formed envelopes from the buffer material. As can be appreciated, various combinations of each of the above-identified aspects may be desirably incorporated into a given assembly for effectively producing envelopes.

DETAILED DESCRIPTION

The present invention will be described with reference to the accompanying drawings which assist in illustrating the pertinent features thereof. In this regard, the present invention is generally an apparatus and method for forming at least one fluid-containing envelope from at least one section of material by transporting the workpiece defined by such section to a plurality of processing stations.

The above-identified types of fluid-containing envelopes can be used for a variety of purposes, one of which is as a padding device. In this particular application, it can be appreciated that it is desirable for the envelopes to be formed from a substantially flexible/pliable material. Appropriate materials include thermoplastic resinous sheets such as polyvinylchloride or polyurethane. Moreover, the type and/or properties of the fluid/fluid-like substance which is provided to these envelopes by the present invention may be desirably selected based upon the specific padding application. For instance, the viscosity of such fluid/fluid-like substances may be selected in this manner and may range from about 100 centipoise to about 1,000,000 centipoise in some circumstances. The fluid/fluid-like is also preferably capable of flowing in response to an applied force. Consequently, the fluid/fluid-like substance may include air and other gases, water and other liquids, and other fluid and fluid-like substances. Preferred materials include glycerine and/or water together with viscosity-enhancing agents such as clay, silica and cellulose-based materials. Wax-/oil mixtures and/or microbeads can also be used. One fluid/fluid-like substance which is particularly appropriate for padding device applications is available from the assignee of this patent application under the trademark "FLOLITE."

Figure 1:
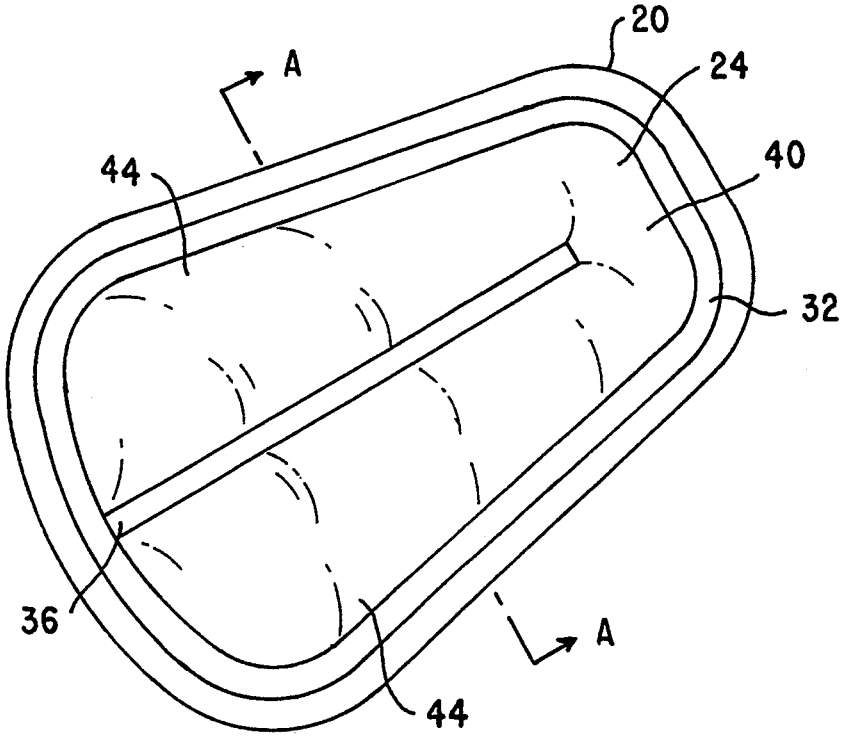
FIG. 1 is a top view of a tongue padding device for a shoe which may be formed by the present invention.
Figure 1A:
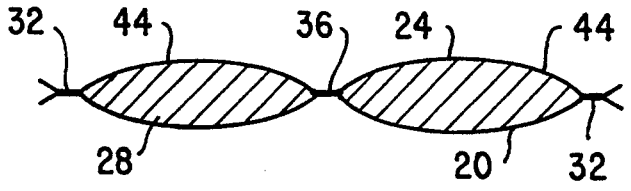
FIG. 1A is a cross-sectional view of the tongue padding device of FIG. 1 taken along line A—A.
Figure 2:
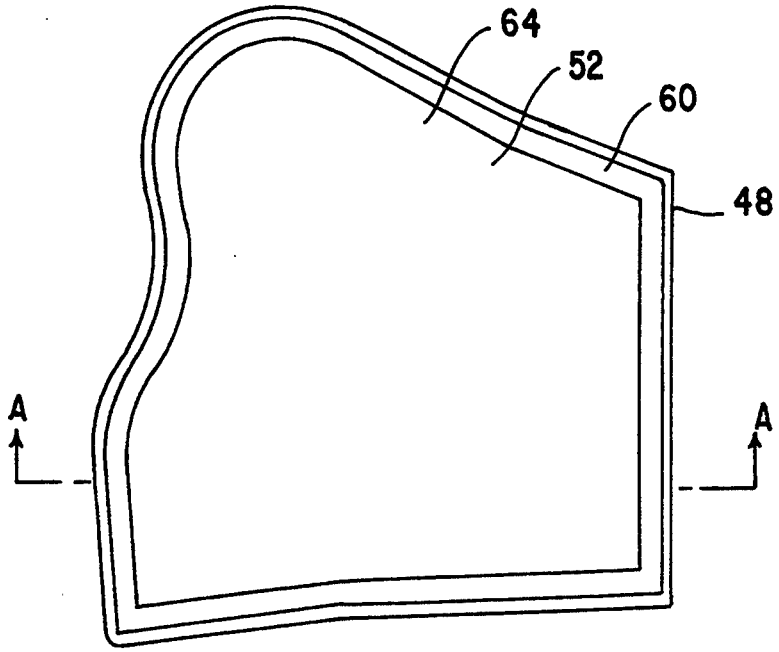
FIG. 2 is a top view of a skate padding device which may be formed by the present invention.
Figure 2A:
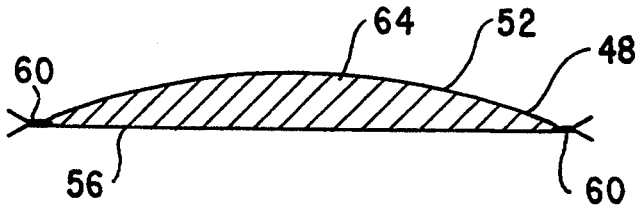
FIG. 2A is a cross-sectional view of the skate padding device of FIG. 2 taken along line A—A.
Figure 3:
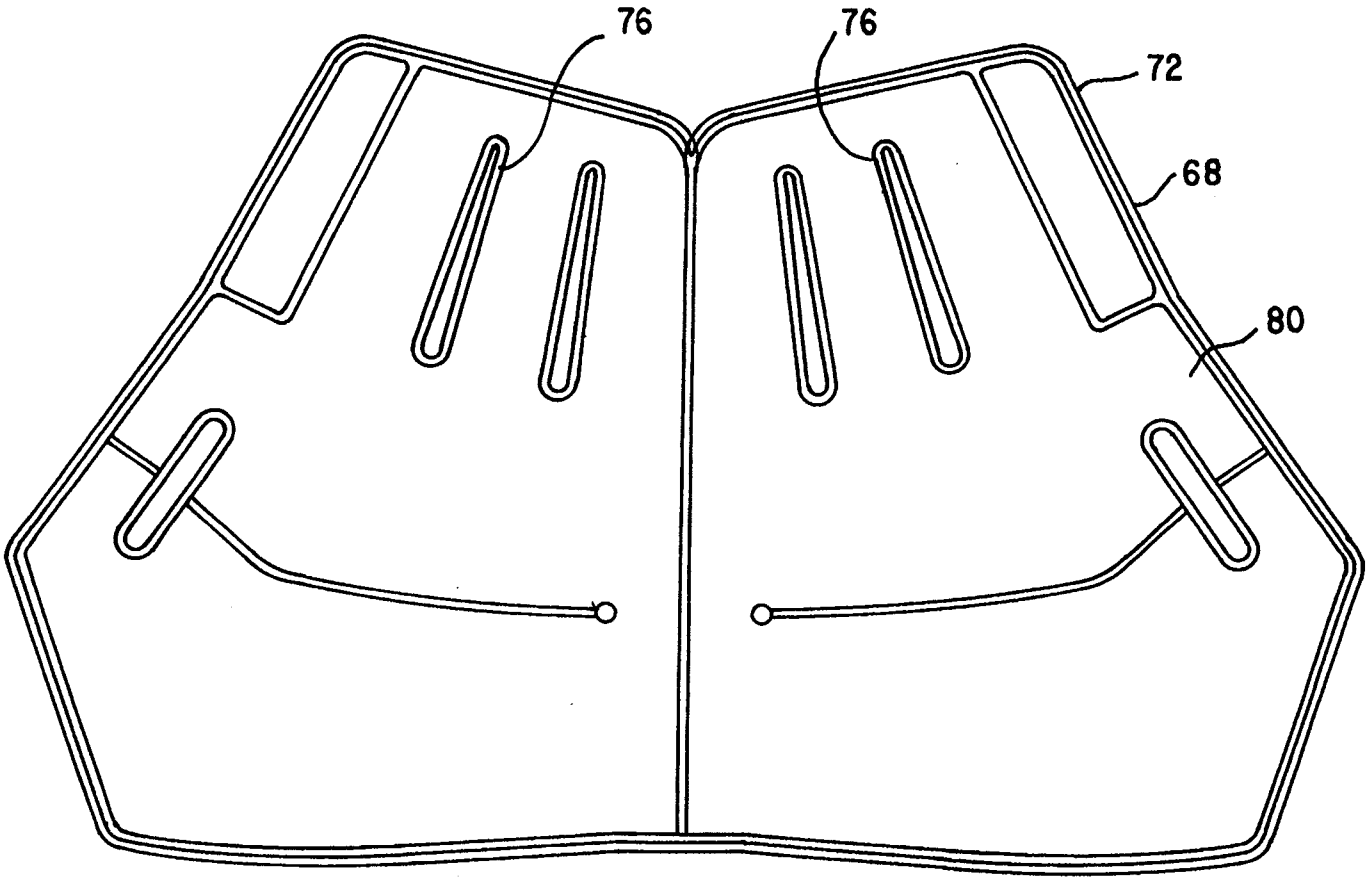
FIG. 3 is a top view of a wheelchair padding device.

One of the above-identified types of envelopes is the tongue padding device 20 of FIGS. 1–1A which includes upper and lower layers 24, 28 that are joined at a perimeter seal 32. The tongue padding device 20 also includes a center seal 36 to define two chambers 44 which are interconnected by a passageway 40 and which each contain an appropriate fluid. The skate padding device 48 of FIGS. 2–2A includes upper and lower layers 52, 56 which are joined along a perimeter seal 60 to define a chamber 64 which contains an appropriate fluid. The wheelchair padding devise 68 of FIG. 3 includes an upper layer 80 (as well as an additional upper layer not shown) and two lower layers (not shown) which are sealed thereto to define a perimeter seal 72 and thereby provide an envelope for containing an appropriate fluid. A plurality of interior seals 76 are also provided. Each of these padding devices 20, 48, 68 may be desirably formed by the present invention.

Figure 4:
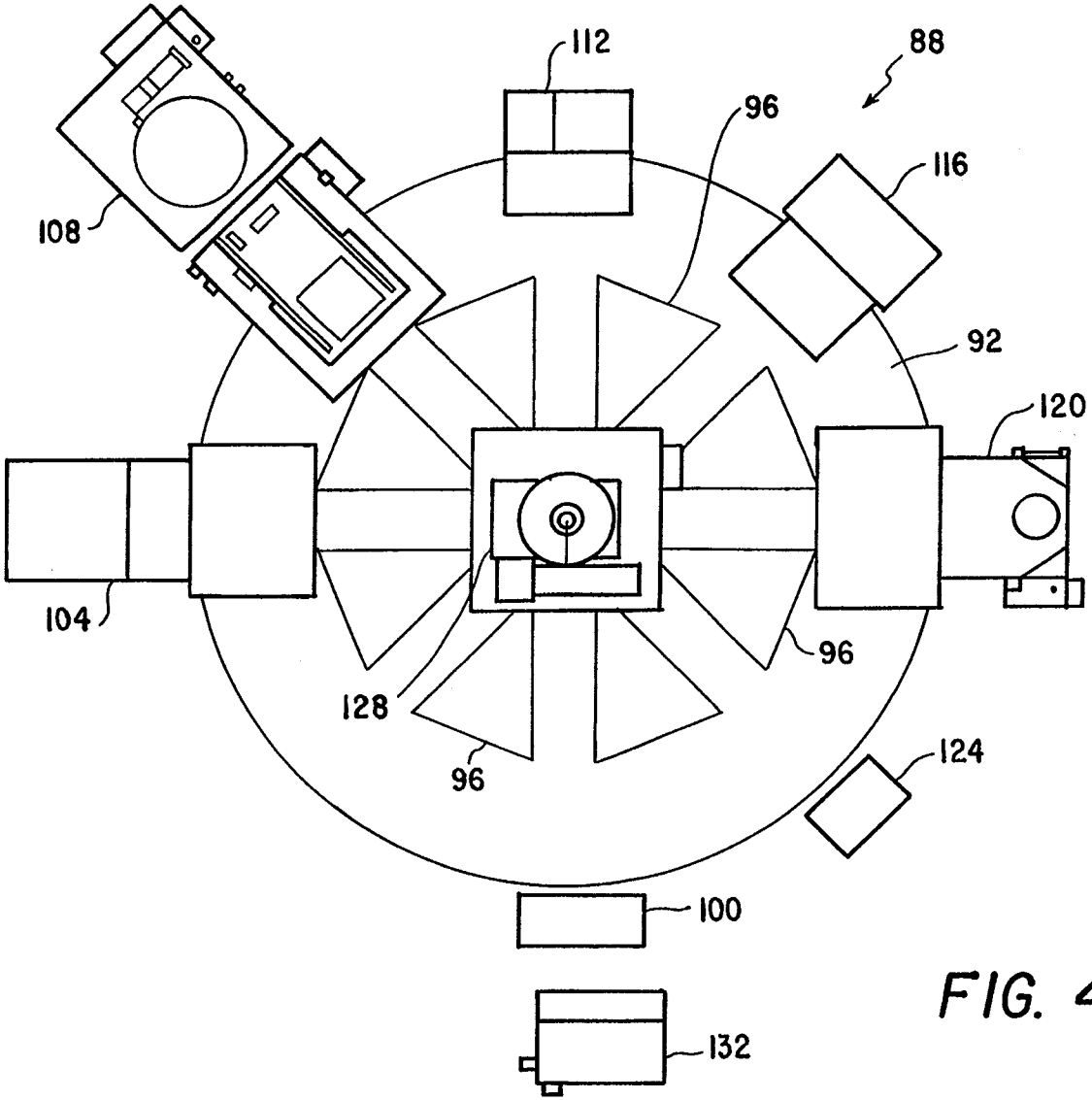
FIG. 4 is a plan view of one embodiment of an envelope forming assembly.

An envelope forming assembly 88 is illustrated in FIG. 4 and generally includes a rotatable turntable 92, loading station 100, primary sealing station 104, filling-/forming station 108, cooling station 112, spout sealing station 116, die cutting station 120, and stripping station 124. In one embodiment the turntable 92 is formed from aluminum and has a diameter and thickness of approximately 144 inches and 0.5 inches, respectively. Consequently, the turntable 92 may incorporate a plurality of rib cutouts 96 to reduce the weight of the turntable 92.

The turntable 92 is raised/lowered and rotated by a drive assembly 128 and an appropriate control assembly 132 between the various processing stations in a predetermined manner. More particularly, when the turntable 92 is to be rotated to position a workpiece at one of the stations, the turntable 92 is lifted to disengage such from any interfacing portions of the particular stations prior to rotation of the turntable 92 to the next position. As can be appreciated, relatively close tolerances must be maintained during rotation of the turntable 92 to ensure a proper positioning of a given workpiece at each of the processing stations. One manner in which this may be addressed is by incorporating appropriate drive systems/controls. One appropriate drive assembly 128 is the 1305 RDM available from CAMCO, the Commercial Cam Division of Emerson Electric Company in Wheeling Ill., and such is described in more detail in the CAMCO Catalog No. 103 (4th printing, June 1988). Moreover, one appropriate control assembly 132 is the PLC®-5/15 System with 6200 Series Programming Software available from Allen-Bradley Company, Inc., and such is described in more detail in the Installation (1989), Installing and Configuring (1990), Testing and Maintenance (1990), and Programming (1990) manuals. As will be discussed below, however, the positioning of the workpiece on the turntable 92 will also of course have an effect on envelope forming operations.

Prior to discussing each of the individual processing stations in detail, the envelope forming sequence for the assembly 88 will be generally described. Initially, the material(s) from which the particular envelope(s) to be formed (e.g., the workpiece which includes superimposed top and bottom layers) are placed on the turntable 92 at the loading station 100. This workpiece is positioned at the primary sealing station 104 by rotation of the turntable 92 in a predetermined increment- At the primary sealing station 104 a substantial portion of the perimeter is provided for each of the envelopes to be formed from the particular workpiece, namely by joining the top and bottom layers together in a predetermined pattern. At least one inlet to each of such envelopes remains and is defined by an unsealed portion(s) of the superimposed layers such that when the workpiece is positioned at the filling/forming station 108 by incremental rotation of the turntable 92, an appropriate fluid may be provided to each such envelope. Once a desired volume of fluid is contained within the envelopes, the turntable 92 positions the workpiece at the cooling station 112 and then to the spout sealing station 116 such that the inlets to each of the envelopes can be sealed to completely define the perimeter of each envelope by a joining of the unsealed portions of the top and bottom layers. Thereafter, the turntable 92 rotates to position the workpiece at the die cutting station 120 where an appropriate die (e.g., which substantially approximates the perimeter of the envelopes in the pattern in which such are on the workpiece) is driven downwardly upon the workpiece to sever the workpiece about the perimeter of each of the envelopes. Finally, the turntable 92 rotates to position the workpiece at the stripping station 124 for removal of the formed envelopes from the turntable 92.

Figure 5A:
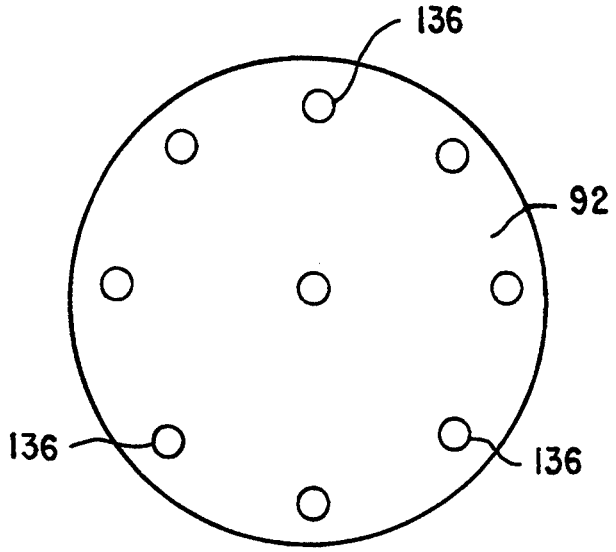
FIG. 5A is a top view of the turntable from the assembly of FIG. 4.

The initial step in the formation of the envelope(s) is to provide a workpiece to an appropriate support such that it may be appropriately transported to the various processing stations. Initially, the turntable 92 of FIG. 5A incorporates a plurality of work stations on which a workpiece may be positioned and which are defined at least in part by a hole 136 which extends through the turntable 92. Therefore, it is possible for a workpiece to be positioned at each of the identified stations of the assembly 88 to enhance the production capacity of the assembly 88.

Figure 5C:
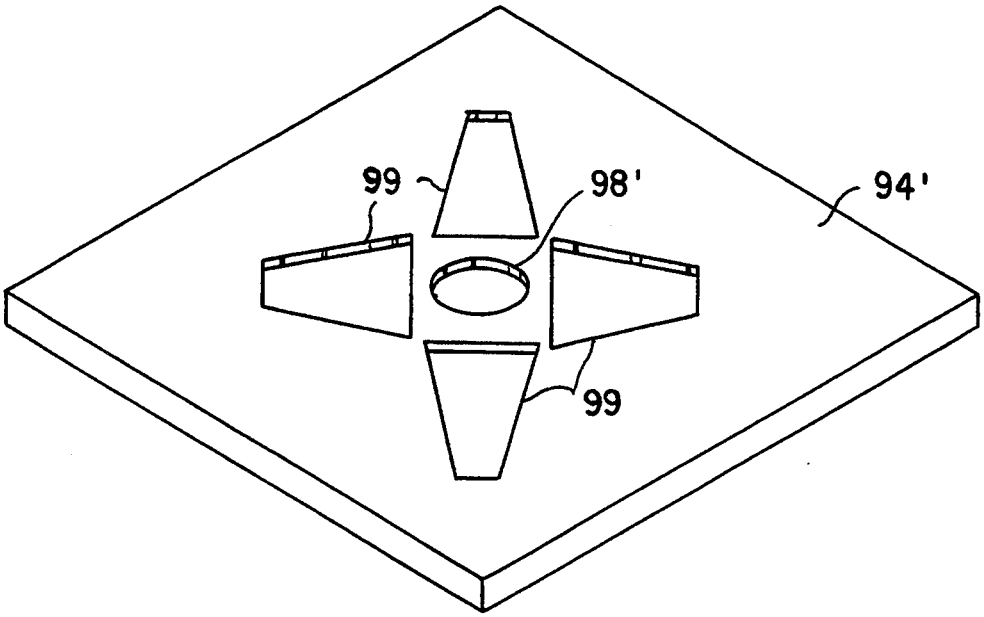
FIG. 5C is a perspective view of an alternate embodiment of a strike plate from that presented in FIG. 5B.
Figure 5B:
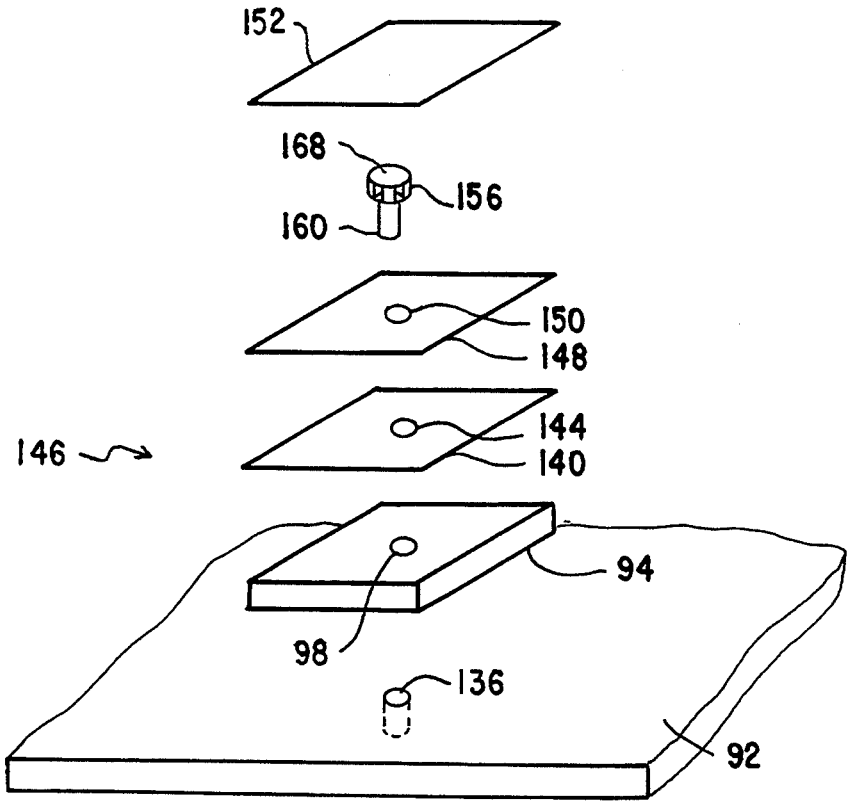
FIG. 5B is a perspective view of one embodiment of a loading station from the assembly of FIG. 4.

One embodiment of one work station for the turntable 92 is more particularly illustrated in FIG. 5B. Initially, a strike or wear plate 94 may be appropriately secured to the turntable 92 and have a hole 98 extending therethrough. The strike plate 94 is substantially planar in this case and reduces wearing of the turntable 92. A buffer material 140 having a hole 144 therein is positioned and attached to the strike plate 94 in an appropriate manner so as to align the hole 144 with the hole 136 on the turntable 92 and the hole 98 in the strike plate 94. As will be discussed in more detail below, this buffer material 140 at least in part serves as a thermal insulator and to maintain the positioning of the workpiece 146 on the turntable 92 when passing between certain of the processing stations. In this regard, appropriate materials for the buffer material 140 include mylar, fish paper, phenolic and glass melamine.

The workpiece from which envelopes are produced is formed from at least one section of the above-identified types of envelope materials, and may be formed from a single piece which is folded to provide two superimposed layers. However, the workpiece may also be formed by two separate sections to provide the desired superimposed configuration. In this regard, the workpiece 146 of Fig. 5B includes a bottom layer 148 having a hole 150 therethrough. The bottom layer 148 is positioned on the buffer material 140 and a male fill tool 156 is positioned through the holes 136, 144, 150. The male fill tool 156 is appropriately keyed (e.g., a flat portion of the side of its stem 160, such that it can be positioned within the hole 136, which may include an interfacing planar portion, in only one orientation). As will be discussed in more detail below, the male fill tool 156 is used to provide the above-identified types of fluid to each of the envelopes to be formed from the workpiece 146. Therefore, a portion of the male fill tool 156 is positioned between the top and bottom layers 152, 148 when the top layer 152 is superimposed over the bottom layer 148.

As can be appreciated based upon the types of materials selected for the buffer material 140 and the bottom and top layers 148, 152, there may be sufficient surface tension between such to maintain the positioning of the workpiece 146 relative to the turntable 92 for purposes of forming the primary seals of the envelopes at the primary sealing station 104. More particularly, the sizes of the bottom and top layers 148, 152 may be selected such that certain movements of such relative to the turntable 92 when positioning the workpiece 146 to the primary sealing station 104 will still allow for proper performance of the sealing operation (i.e., movement of a certain degree will still result in formation of the primary seals for the envelopes being formed). However, this is not the case with the stations 108, 116, and 120 where a fixed orientation of the workpiece 146 relative to the turntable 92 is desirable to increase the potential for proper performance of the associated operations.

In the embodiment of FIG. 5B, the buffer material 140 is positioned on the substantially planar strike plate 94 of the turntable 92. As will be discussed below, portions of the strike plate 94 coinciding with the envelopes being formed will define a bottom portion of such envelopes. As can be appreciated, under certain conditions in may be desirable for the bottom of the envelope to have a "bulbous" configuration. Therefore, in another embodiment the strike plate 94' of FIG. 5C incorporates an envelope cavity 99 for receiving each envelope to be formed from a particular workpiece (i.e., to allow the envelope to expand therein when fluid is provided thereto). These cavities 99 are positioned substantially about the hole 98'. In this case, the buffer material 140 may be configured so as to not extend into these cavities 99, but only to be positioned therearound. However, a sufficient amount of buffer material 140 remains externally of such cavities 99 for interfacing with the bottom layer 148 for purposes of maintaining the positioning of such on the turntable 92 at the primary sealing station 104 as will be discussed below.

Figure 6:
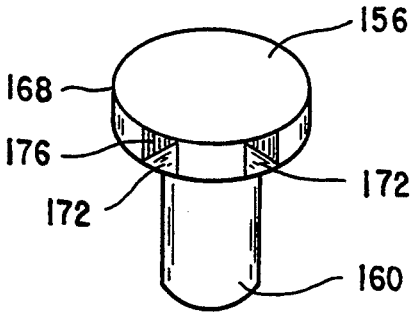
FIG. 6 is a perspective view of one embodiment of a male fill tool for use in a filling/forming station.
Figure 10:
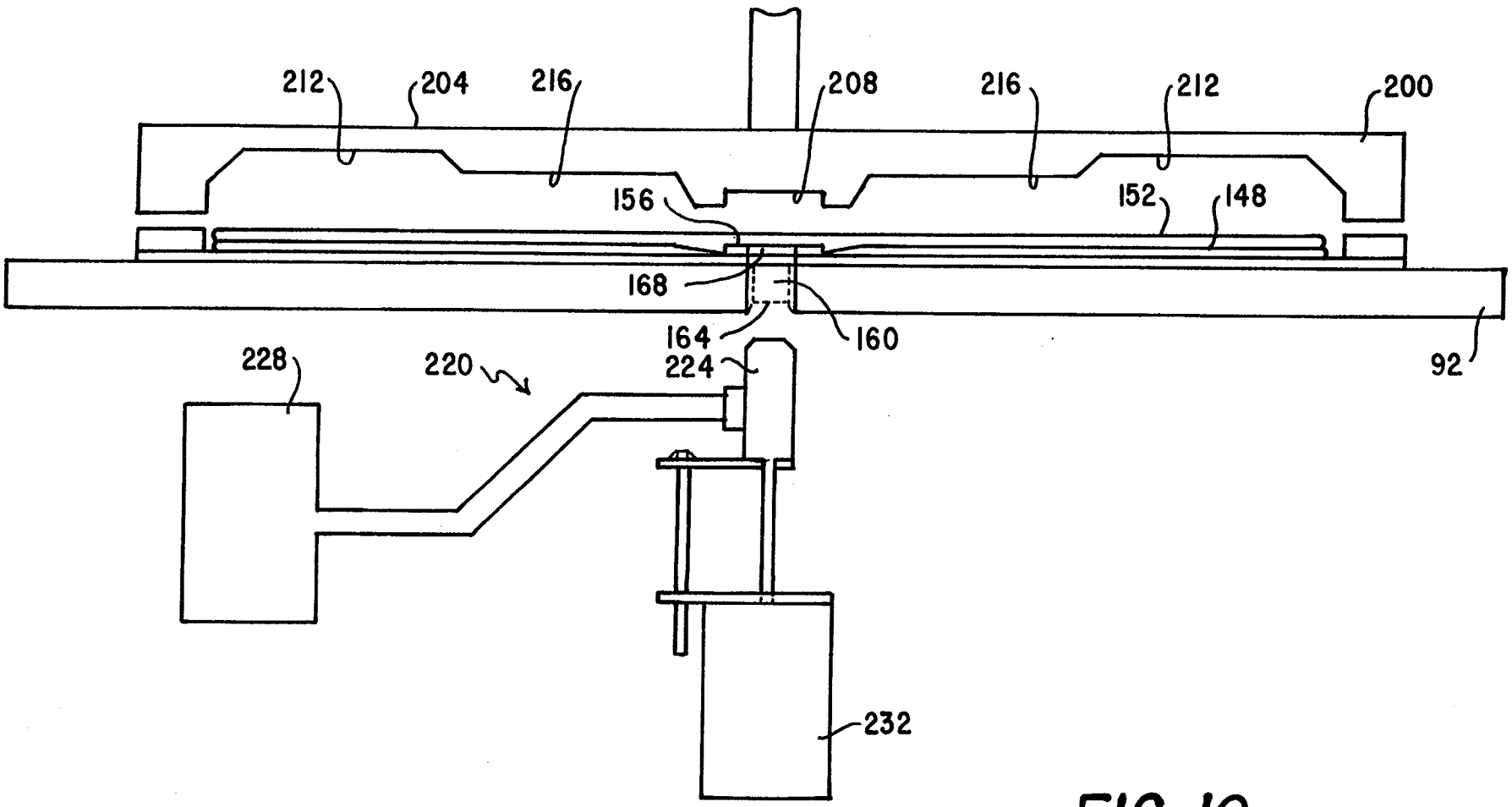
FIG. 10 is one embodiment of an envelope former/-filler for use in a filling/forming station.

As previously noted, the male fill tool 156 provides a means for introducing the above-identified types of fluid between the top and bottom layers 152, 148. One embodiment of the male fill tool 156 is more particularly illustrated in FIG. 6. The male fill tool 156 generally includes a head 168 and stem 160. The stem 160 is again positioned within one of the holes 136 on the turntable 92 and is fluidly interconnectable with a fluid source when the workpiece 146 is positioned at the filling-/forming station 108. The male fill tool 156 further incorporates a head 168 having a plurality of apertures 172 therein, one such aperture 172 being provided for each such envelope to be formed from a given workpiece to provide fluid thereto. Therefore, the male fill tool 156 incorporates a central conduit 164 (FIG. 10) and a conduit 176 for interconnecting each aperture 172 with the center conduit 164.

With the workpiece 146 positioned on the turntable 92 at the loading station 100, the turntable 92 is rotated by the drive and control assemblies 128, 132 to position the workpiece 146 at the primary sealing station 104. Once again, the turntable 92 is first lifted and then rotated in the predetermined increment to establish proper positioning of each workpiece on the turntable 92 at the respective processing station, one of which is the workpiece 146 at the primary sealing station 104.

Figure 7:
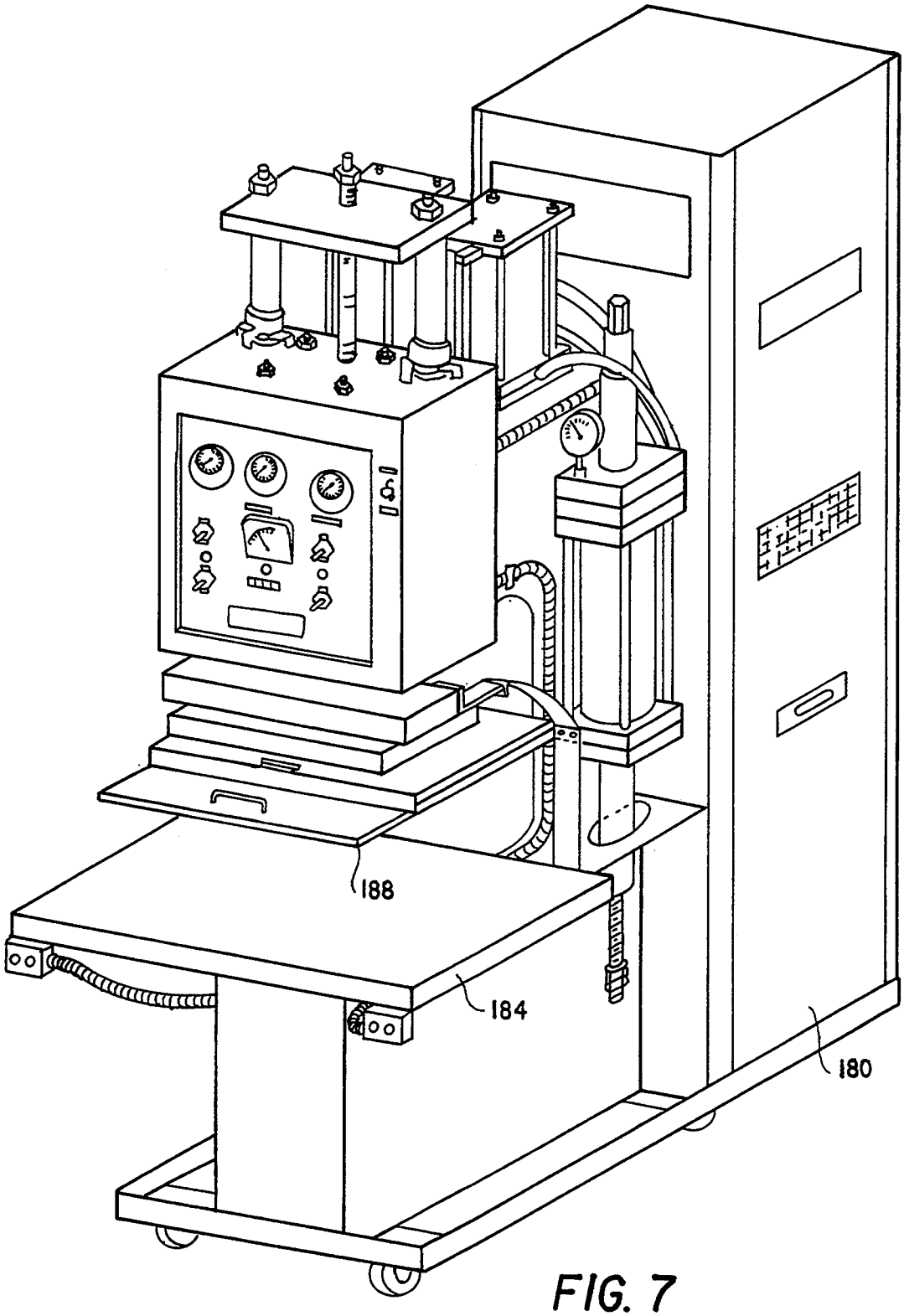
FIG. 7 is a perspective view of one embodiment of an RF sealer for the primary and/or spout sealing stations.

As noted above, the primary sealing station 104 provides the primary seal for each envelope to be formed from the workpiece 146. Various methods may be appropriate for establishing this primary seal between the top and bottom layers 152, 148 in the predetermined pattern to define each such envelope, including thermal and radio frequency sealing. One embodiment of an RF sealer 180 is illustrated in FIGS. 7–8 and was formerly manufactured by and available from Sealomatic Electronics Corporation of Brooklyn New York, namely the Sealomatic 600FS, under the mark "SEALOMATIC." The Sealomatic 600FS is described in more detail in its operating/instruction manual provided therewith.

Generally, the RF sealer 180 includes a base plate 184 over which the turntable 92 positions the workpiece 146 and a die mounting plate 188 which is positionable above the workpiece 146. A die 192 (FIG. 8 and for forming the tongue padding devices 20 of FIGS. 1–1A) having a raised contour 196 to define the desired portion of each of the envelopes to be formed from the workpiece 146 is appropriately attached to die mounting plate 188. Consequently, with the workpiece 146 being appropriately positioned, the die mounting plate 188 is driven down into engagement with the base plate 184 and a high radio frequency wave is transmitted through the die 192 onto the base plate 184 to seal the top and bottom layers 152, 148 at the described locations. (e.g., conductive electrodes are used to provide the desired seal). Appropriate detectors (e.g., photoelectric) may be incorporated on the RF sealer 180 for monitoring the positioning of the die 192 for purposes of interacting with the drive and/or control assemblies 128, 132.

Figure 8:
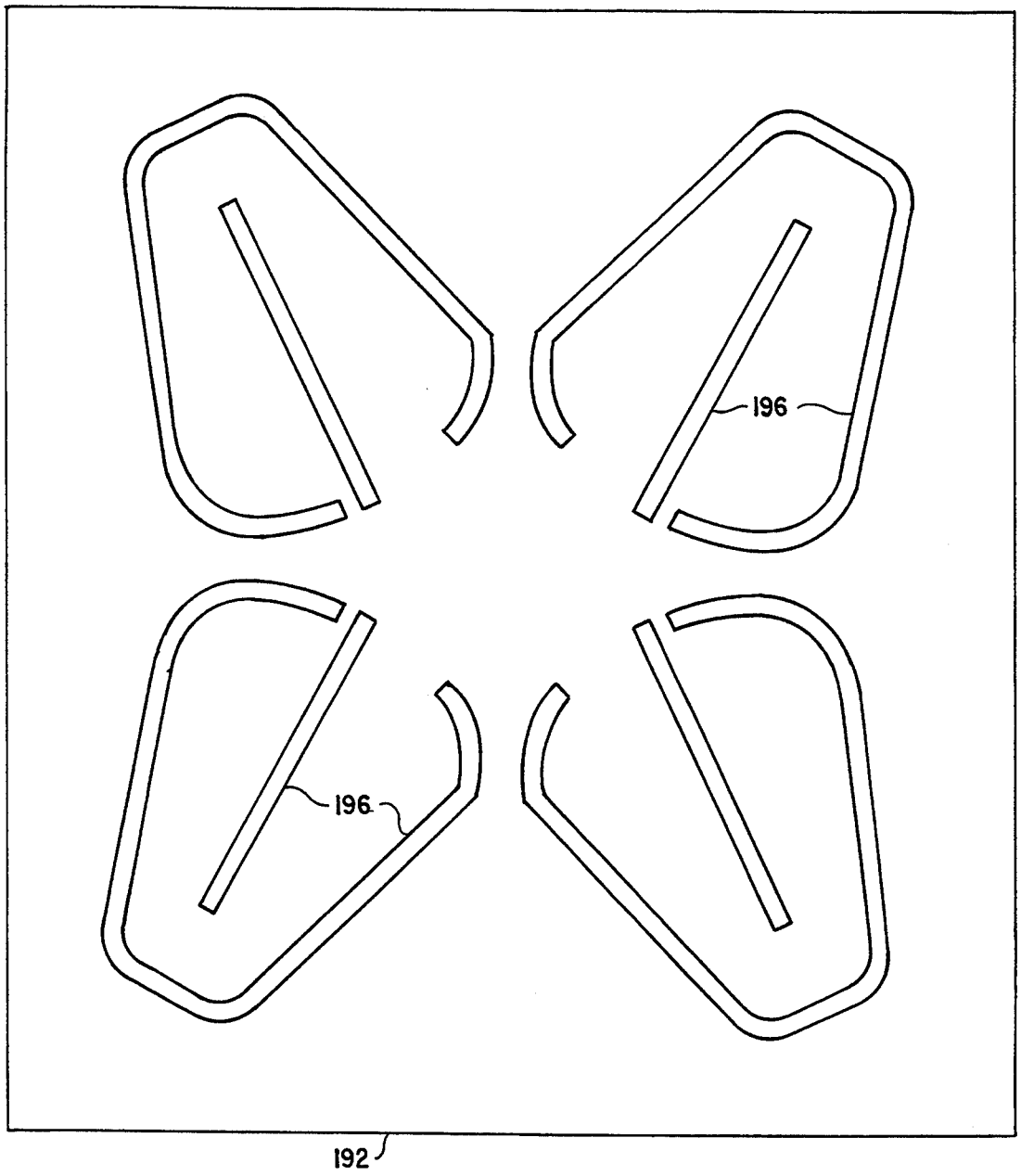
FIG. 8 is one embodiment of a die for use with the RF sealer of FIG. 7.
Figure 9:
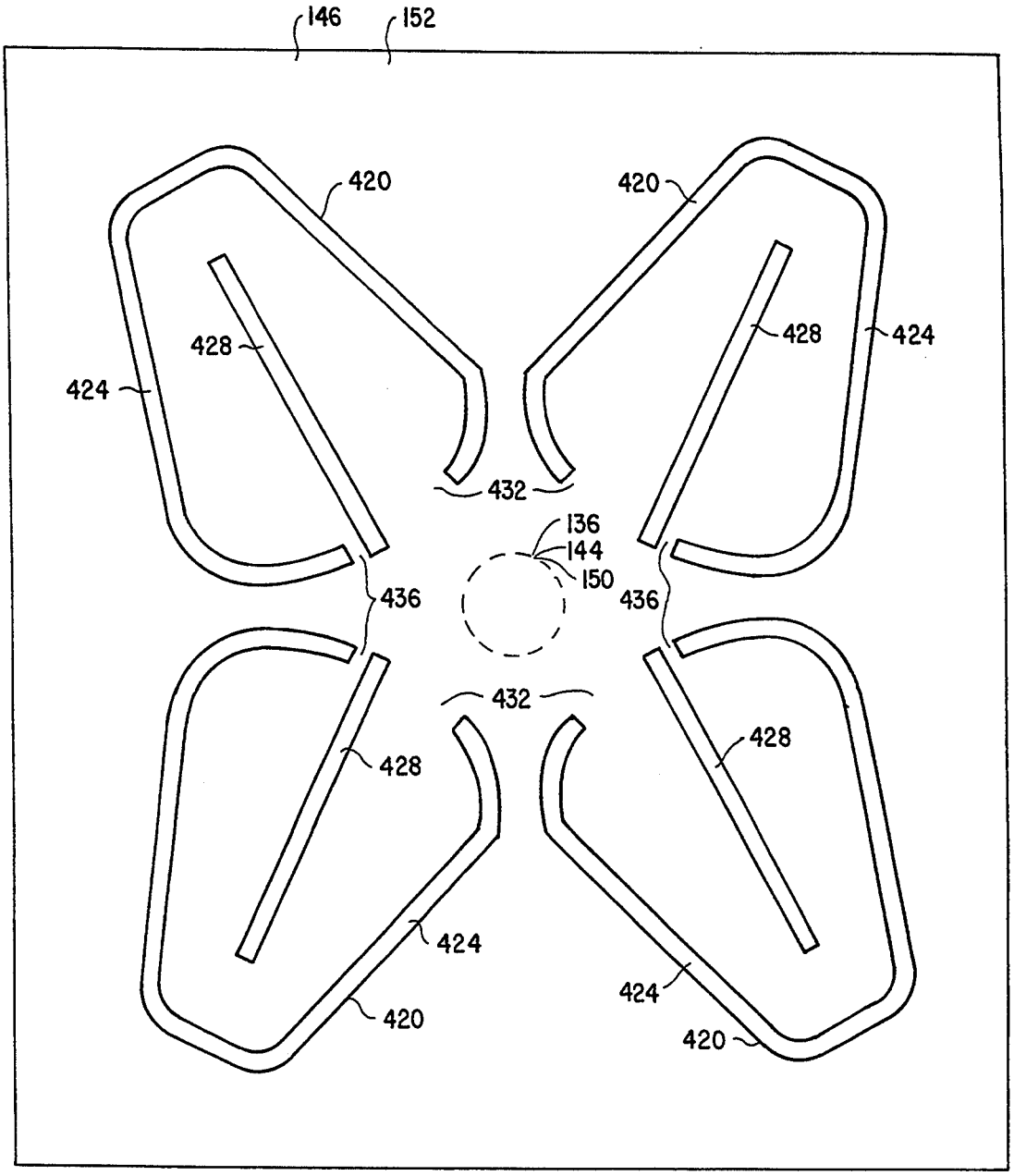
FIG. 9 is a top view of one embodiment of partially formed envelopes, namely after the primary seal has been formed by the RF sealer of FIG. 7 using the die of FIG. 8.

In the case where the die 192 of FIG. 8 is utilized, the configuration of the workpiece 146 is as illustrated in FIG. 9. The workpiece 146 now includes four partially formed envelopes 420 similar to the tongue padding devices 20 of FIGS. 1–1A discussed above. More particularly, a first perimeter seal 424 and center seal 428 is provided for each such envelope 420. However, in order to allow an appropriate fluid to be introduced between the bottom and top layers 148, 152 at the filling/forming station 108 to be discussed below, at least one inlet 432, defined by the lack of a seal between the top and bottom layers 152, 148 in this region, is provided for each envelope 420. Moreover, a vent 436 may be provided for each such envelope 420 and "formed" in a similar manner to the inlets 432. The vents 436 allow any air within the partially formed envelopes 420 to be expelled therefrom during injection of fluid therein such that in some circumstances a separate processing step need not be performed to remove such air.

In addition to providing the primary seal for the envelopes 420, the RF sealer 180 also provides for a "tacking" down of the bottom layer 148 of at least a portion of the workpiece 146 to the buffer material 140 (e.g., a mechanical-type bond), typically in the region of the buffer material 140 which underlies the first perimeter seal 424 (e.g., the contour of the die used with the RF sealer 180 such as the die 192 of FIG. 8). Since the top and bottom layers 152, 148 are also sealed together by the RF sealer 180, the workpiece 146 is thus effectively maintained in a fixed orientation on the turntable 92. This allows for the turntable 92 to position the workpiece 146 at each of the subsequent stations (e.g., stations 108, 116, 120) with the degree of accuracy required to enhance the potential for ensuring that the operations performed at such stations are properly performed.

Once the first perimeter seal 424 is provided by the RF sealer 180 for each of the envelopes 420, the turntable 92 is lifted (e.g., to disengage the turntable 92 from the base plate 184, as well as other interfacing portions at the various stations) and rotated in a predefined increment by the drive and control assemblies 128, 132 to position the workpiece 146 at the filling/forming station 108. The filling/forming station 108 may include the envelope filler/former 200 of FIG. 10. The envelope filler/former 200 generally includes a forming die 204, which at least assists in defining at least a portion of a contour of the envelopes 420, and a filling assembly 220, which provides the above-identified types of appropriate fluid to each of such envelopes 420.

Figure 11:
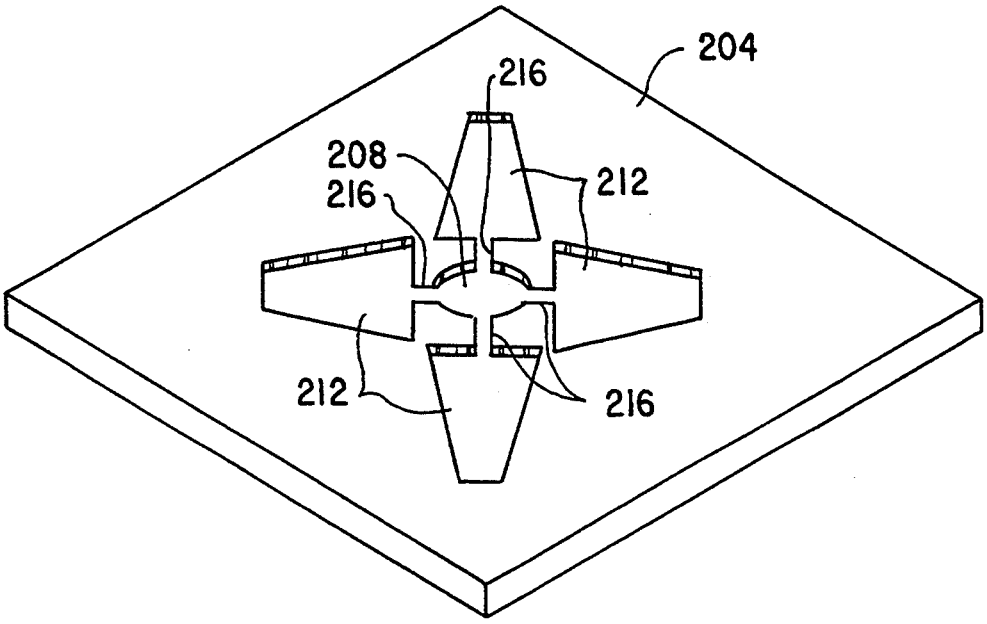
FIG. 11 is a perspective view of one embodiment of a forming die for use with the envelope former/filler of Fig.

One embodiment of the forming die 204 is more particularly illustrated in FIG. 11. The forming die 204 incorporates a female fill tool 208 integrally therein (e.g., a cavity) for receiving the head 168 of the male fill tool 156. The forming die 204 further includes a plurality of envelope cavities 212, the number of cavities 212 coinciding with the number of envelopes 420 to be formed from each workpiece 146. Each envelope cavity 212 is interconnected with the female fill tool 208 by a concave (i.e., open) channel 216. Since the envelope cavities 212 are substantially symmetrically positioned about the male fill tool 156, the channels 216 may be of substantially the same length. As can be appreciated, this may allow for the provision of substantial equal quantities of fluid to each envelope 420 and potentially compensate for the viscosity of the fluids being used.

Referring back to FIG. 10, the above-described forming die 204 is driven downwardly such that the forming die 204 forcibly engages the top layer 152 of the workpiece 146 and such that the female fill tool 208 forces the male fill tool 156 into engagement with the bottom layer 148. Moreover, the envelopes 420 are substantially contained within the envelope cavities 212. Consequently, a flow path is defined between the top and bottom layers 152, 148 in the regions coinciding with the channels 216 for the provision of an appropriate fluid to each of the envelopes 420 by the filling device 220.

The filling device 220 generally include a reservoir 228 which contains a supply of the appropriate fluid, an injection pump (not shown), a nozzle 224, and a positioning mechanism 232. When the turntable 92 is appropriately rotated to position the workpiece 146, again being maintained in a fixed position relative to the turntable 92 by the "tacky" engagement of the bottom layer 148 on the buffer material 140, the nozzle 224 is driven into fluid engagement with the center conduit 164 of the stem 160 of the male fill tool 156 by the positioning mechanism 232. Fluid from the reservoir 228 is then pumped through the nozzle 224 and fluid flows through each of the apertures 172 into the aligned channel 216 and to each of the envelopes 420. This causes the upper layer 152 to eventually conform to the contour of the associated envelope cavity 212 if sufficient fluid is provided to the envelopes 420. Various manners may be used to monitor/ control the amount of fluid, such as based upon timing (knowing pump volumetric capacity) or using appropriate sensors. As with the RF sealer 180, appropriate sensors (not shown) may be incorporated to monitor the position of the filler/former 200 for interfacing with the drive and control assemblies 128, 132.

Although the above-described symmetrical positioning of the envelopes 420 about the male fill tool 156 enhances the potential for a substantially equal amount of fluid being provided to each of the envelopes 420, it may be desirable to apply heat to the forming die 204 or various portions thereof to reduce the viscosity of the fluid and thereby further enhance the potential for providing substantially equal amounts of fluid to each envelope. For example, in the event that a particular envelope 420 is not receiving the same volume of fluid as the remaining envelopes 420, heat may be applied to the forming die 204 in the region of this particular envelope 420 and/or the channel 216 leading thereto to increase the ability of the fluid to flow therein (i.e., in subsequent operations and thus relating to correcting flow patterns for subsequently produced envelopes 420). This particular feature may be incorporated into all configurations utilized at the filling/forming station 108 and/or with the various configurations of envelopes formable by the present invention.

Figure 12:
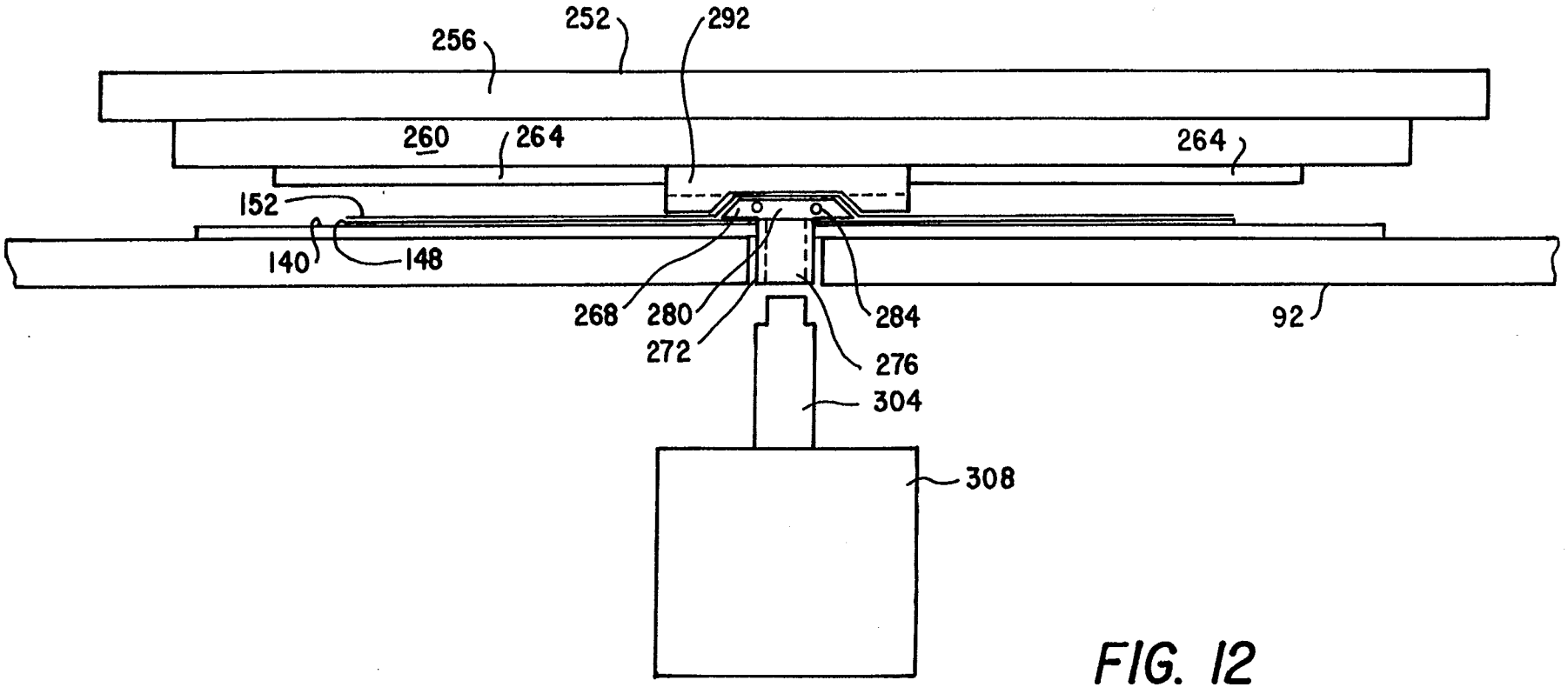
FIG. 12 is one embodiment of an envelope former/-filler for use in a filling/forming station.

Another envelope filler/former 252 which may be incorporated at the filling/forming station 108 is illustrated in FIG. 12. Generally, the filler/former 252 includes a press platen 256, fill plate 260, fill spacer 264, female fill tool 292, male fill tool 268, injection nozzle 304, and injection manifold 308. The fill plate 260 is appropriately secured to the press platen 256 and the female fill tool 292 and fill spacer 264 are each appropriately secured to the fill plate 260 to provide simultaneous vertical movement of such components at the desired time. In this regard, when the female fill tool 292 is directed into the position of FIG. 12, fluid from the injection manifold 308 and injection nozzle 304 is directed to the male fill tool 268 and then the female fill tool 292 which directs the flow of fluid to each of the envelopes 420.

Figure 13A:
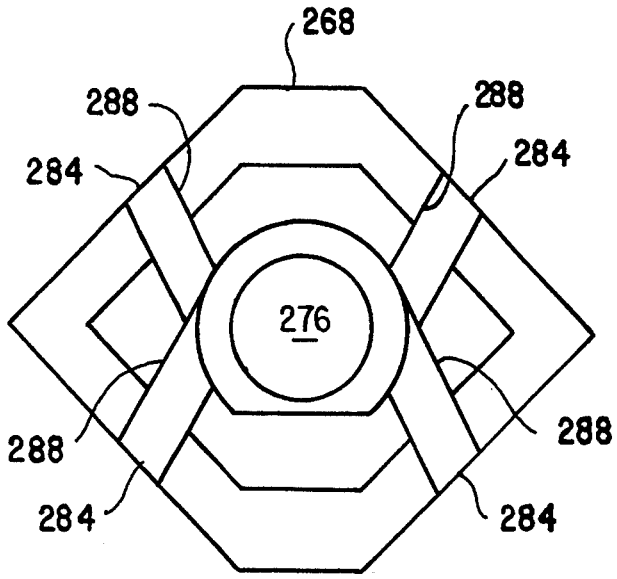
FIG. 13A is a top view of one embodiment of a male fill tool.
Figure 13B:
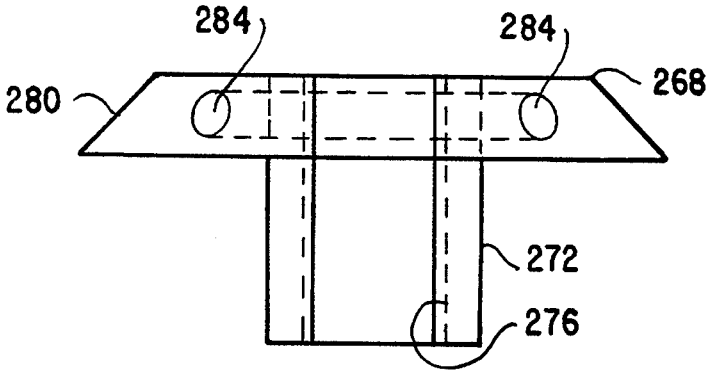
FIG. 13B is one side view of the male fill tool of FIG. 13A.
Figure 13C:
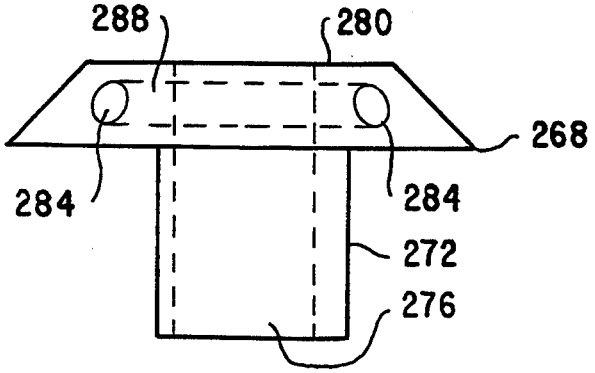
FIG. 13C is another side view of the male fill tool of FIG. 13A.

One embodiment of the male fill tool 268 is more particularly illustrated in FIGS. 13A–C. Generally, the tool 268 is functionally similar to the tool 156 discussed above. Therefore, the male fill tool 268 includes a stem 272, positionable in the hole 136 in the turntable 92, and a head 280, positionable between the upper and lower layers 152, 148 as noted above with regard to the male fill tool 156. Moreover, the tool 268 includes a center conduit 276 and a plurality of apertures 284 which are appropriately connected to the center conduit 276 by conduits 288. Once again, an aperture 284 is provided for each envelope 420 to be formed from the workpiece 146.

Figure 14A:
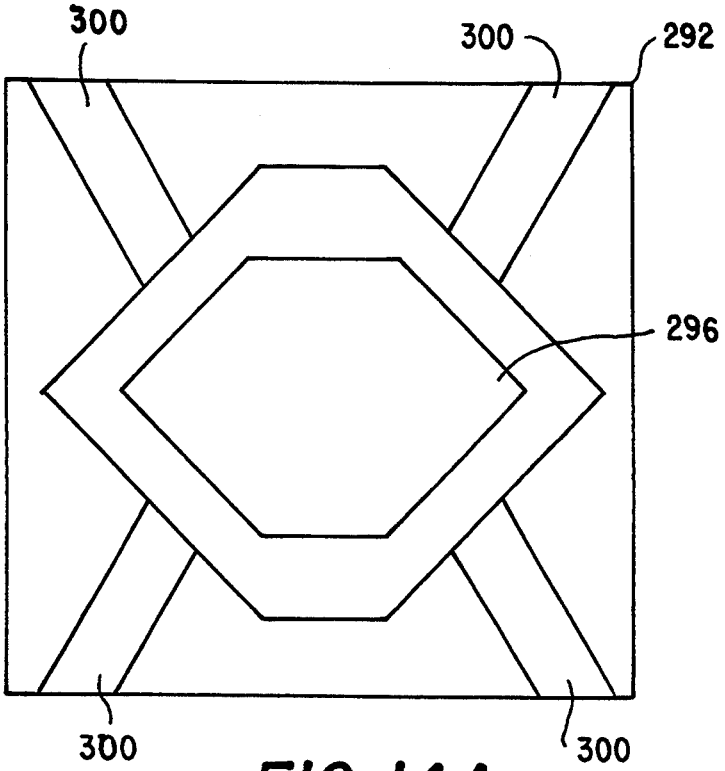
FIG. 14A is a top view of one embodiment of a female fill tool for use with the envelope former/filler of FIG. 12.
Figure 14B:
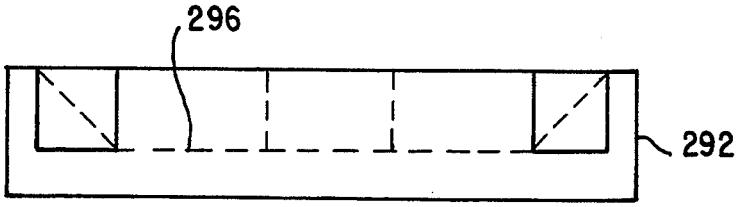
FIG. 14B is one side view of the female fill tool of FIG. 14A.
Figure 14C:
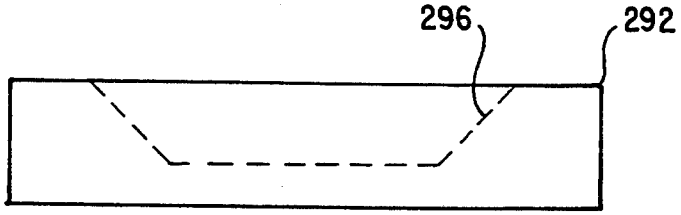
FIG. 14C is another side view of the female fill tool of FIG. 14A.

One embodiment of the female fill tool 292 is more particularly illustrated in FIGS. 14A–C. Generally, the female fill tool 292 includes a receiving cavity 296 for receiving the head 280 of the male fill tool 268. Moreover, the female fill tool 292 includes a plurality of channels 300 which serve to fluidly interconnect the male fill tool 268 with each of the envelopes 420 to be formed from a single workpiece 146. In this regard, when the press platen 256 is driven downwardly, the female fill tool 292 forcibly engages the head 280 of the male fill tool 268 and forcibly engages the top layer 152 such that portions of the top and bottom layers 152, 148 coinciding with the channels 300 provide a fluid conduit to each such envelope 420.

When fluid is provided to each of the envelopes 420 via the injection manifold 308, injection nozzle 304, male fill tool 268, and channels 300, the envelopes 420 expand. The amount of this expansion may be limited by the fill spacer 264. In order to allow for various sizes (e.g., thicknesses) of envelopes 420 to be formed, the fill spacer 264 is appropriately detachably connected to the fill plate 260 such that it may be readily replaced with a fill spacer 264 of a different thickness. It may also be possible to incorporate sensors on the fill spacer 264 to control the provision of fluid to the envelopes 420.

Figure 15:
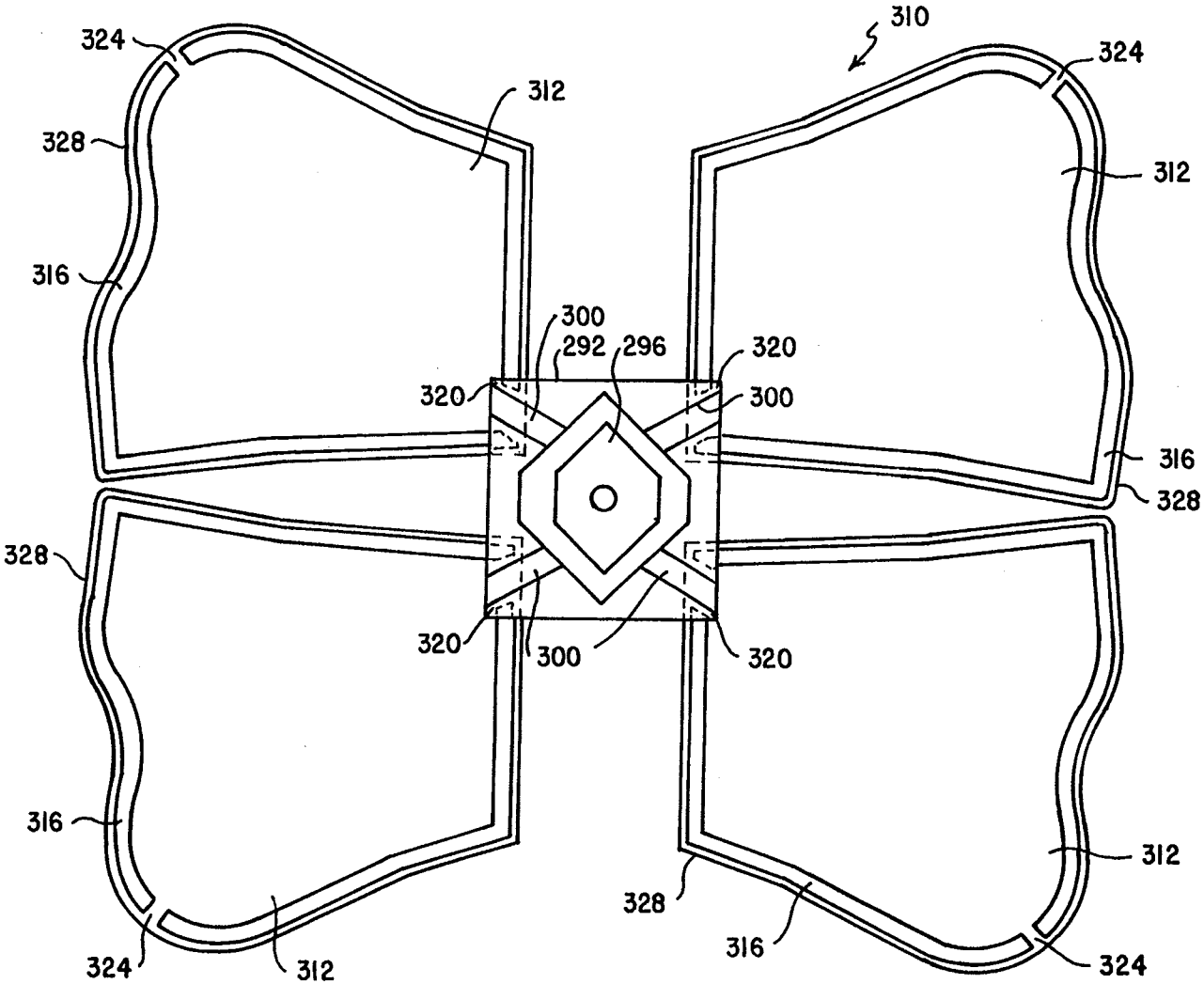
FIG. 15 is a view illustrating the positioning of the female fill tool of FIGS. 14A–C when used to form the skate padding device of FIG. 2.
Figure 15A:
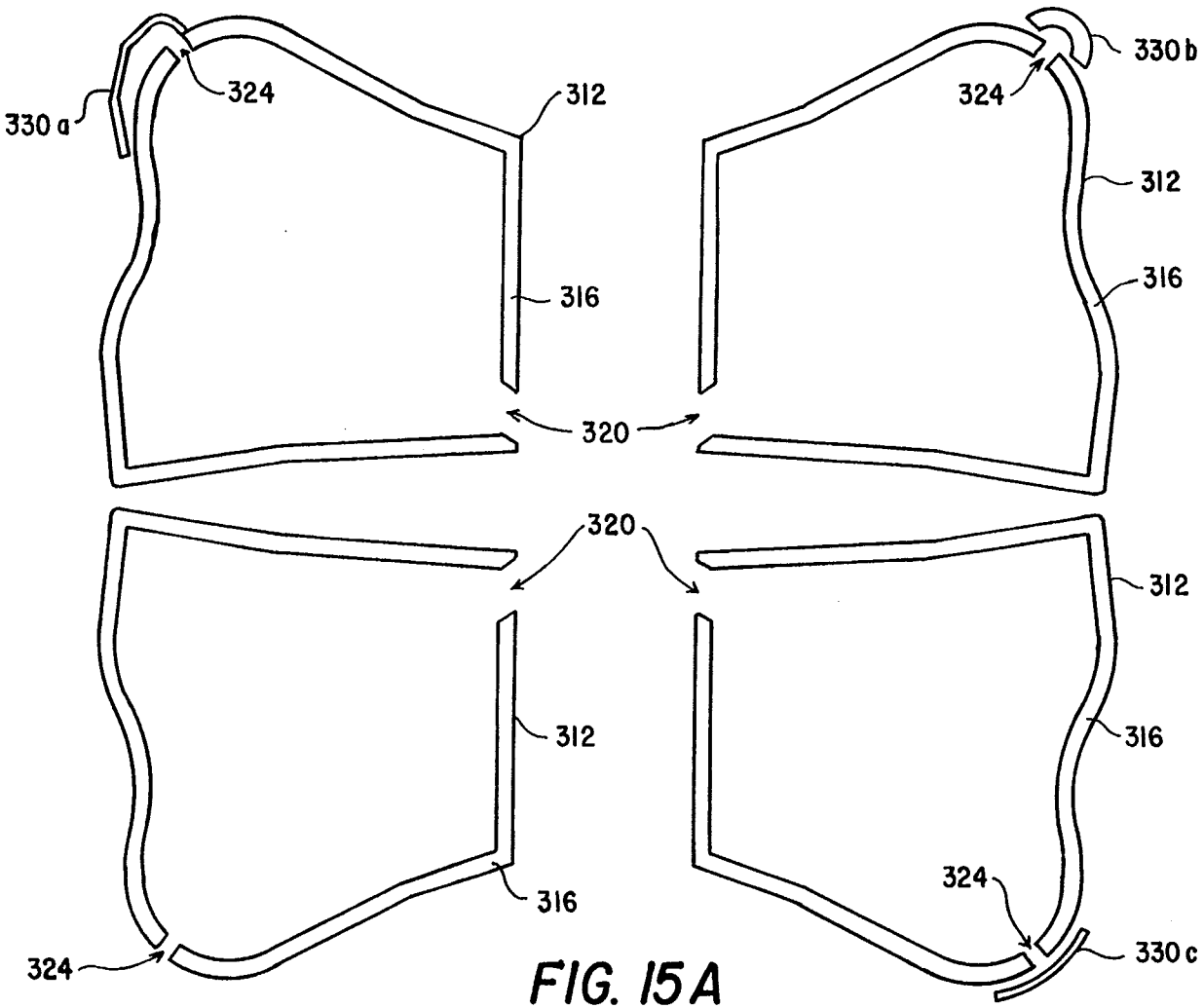
FIG. 15A is a view illustrating a number of embodiments of dams which may be positioned proximate to the vent(s) of a given envelope prior to introducing fluid therein.

Another workpiece 310 which may be used with either the envelope filler/former 200 or 252 is illustrated in FIG. 15 in conjunction with the filler/former 252. More particularly, FIG. 15 illustrates the interrelationship between the female fill tool 292, its channels 300, and the envelopes 312. The envelopes 312 are substantially similar to the skate padding devices 48 of FIGS. 2–2A discussed above. After the upper and lower layers of the workpiece 310 have been sealed by an appropriately configured die (not shown) at the primary sealing station 104, a first perimeter seal 316, inlet 320, and vent 324 are provided by sealing of the upper and lower layers together. Therefore, one channel 300 is aligned with an inlet 320 to each of the envelopes 312.

In order to assist in the introduction of the fluid into each of the envelopes 312, it may be desirable to position a dam 330 external of the first perimeter seal 316 and adjacent to each of the vents 324 as illustrated in FIG. 15C. The dams 330 may assume a variety of configurations a, b, and/or c and may be formed by sealing the upper and lower layers of the workpiece 310 together at the primary sealing station 104. Alternatively, the dams 330 may be provided at the filling/forming station 108 by engaging a member (not shown), similarly configured to the dams 330, down upon the upper layer of the workpiece 310o By incorporating these dams 330, the flow of fluid out of the vents 324 is at least retarded, whereas air continues to be allowed to be evacuated from each of the envelopes 312 (e.g., the dams 330 provide a back pressure which assists in the introduction and retention of fluid within the envelopes 312). Although the dams 330 have been described with regard to the envelopes 312, it can be appreciated that it may be desirable to incorporate such or similar dams on various other configurations of envelopes formable by the present invention.

After the envelopes 420 of workpiece 146 are injected with an appropriate amount of fluid at the filling/forming station 108, the workpiece 146 is positioned at the cooling station 112 by rotation of the turntable 92 in a predetermined increment by the drive and control assemblies 128, 132. The cooling station 112 may comprise a nozzle for applying air at an appropriate temperature and velocity to the workpiece 146. This cooling of the workpiece 146 may be used to increase the viscosity of the fluid within its envelopes 420 since, as noted above, the envelopes 420 are not yet completely sealed. However, under some circumstances this cooling of the workpiece 146 may not be required.

In order to complete the definition of each of the envelopes 420 of the workpiece 146, the turntable 92 is rotated in a predetermined increment by the drive and control assemblies 128, 132 to position the workpiece 146 at the spout sealing station 116. The spout sealing station 116 seals the inlets 432 and vents 436 for each of the envelopes 420 of the workpiece 146 by joining the upper and lower layers 152, 148 together in an appropriate manner. Consequently, an RF sealer 180 similar to that incorporated in the primary sealing station 104 discussed above may be used at the spout sealing station 116; provided, however, that the configuration of the electrodes is modified to accommodate sealing of the inlets 432 and vents 436. However, another appropriate apparatus for sealing the top and bottom layers 152, 148 together at the inlets 432 and vents 436 is the Thermatron KF64S from Thermatron, a Division of Solidyne, Inc. The Thermatron KF64S is described in more detail in the instruction/operating manual provided therewith. Once the inlets 432 and vents 436 to each envelope 420 are sealed in an appropriate manner each envelope 420 is defined by a substantially fluid-tight seal.

As can be appreciated, since the size of the inlets 432 and vents 436 are relatively small, when the workpiece 146 is provided to the spout sealing station 116 it must be accurately positioned. More particularly, in the event that the workpiece 146 moves relative to the turntable 92 while being positioned at the spout sealing station 116, it may be possible that the inlets 432 and vents 436 will not be completely sealed. In this case, defective envelopes 420 would result, namely by having one or more leaks. Therefore, it is once again desirable for the described interaction between the buffer material 140 and the bottom layer 148 to continue such that the workpiece 146 remains in the predetermined position on/relative to the turntable 92.

Figure 16:
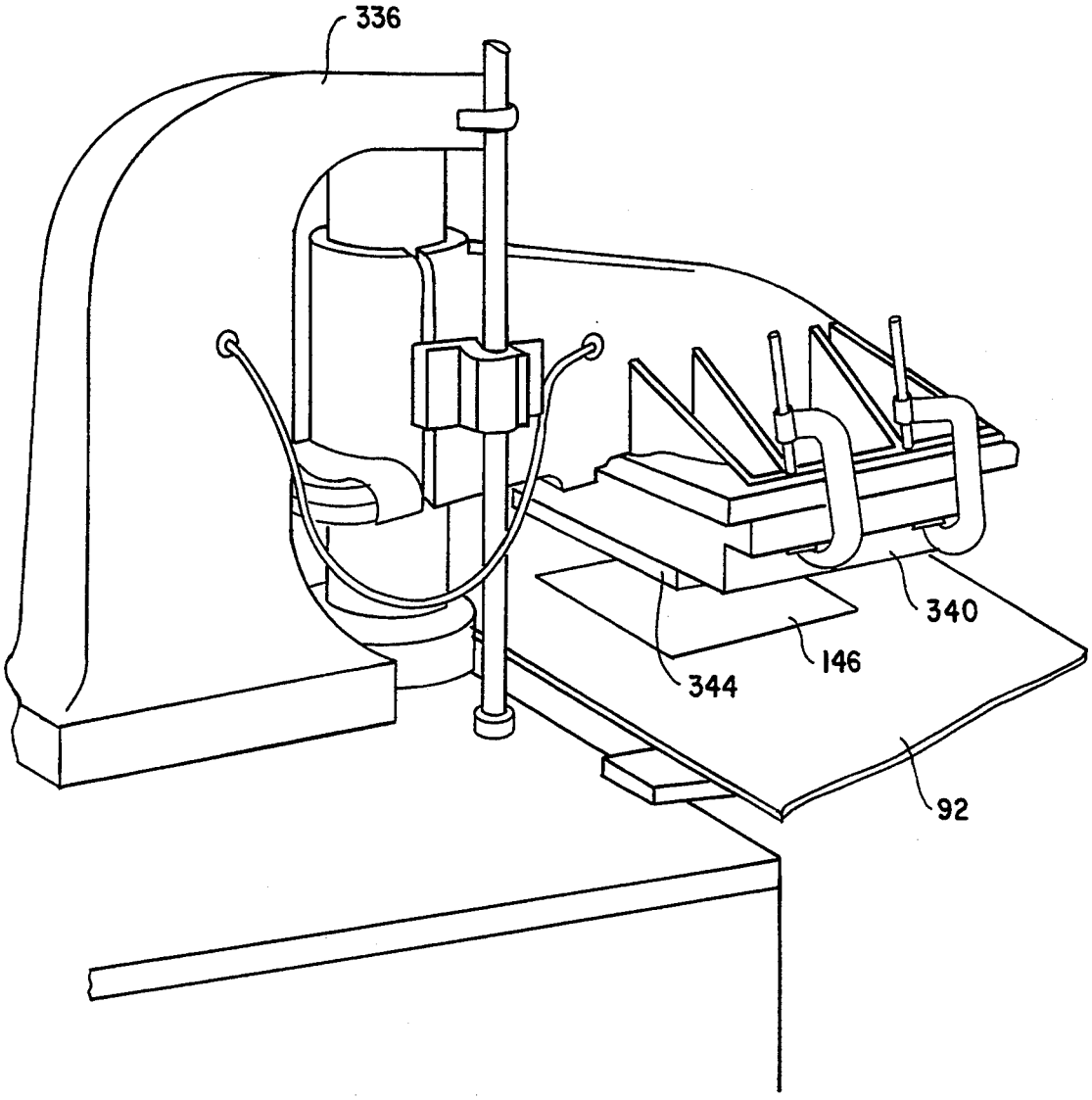
FIG. 16 is one embodiment of a punch press for a die cutting station.

After the envelopes 420 are completely defined (e.g., with a totally secured perimeter and with fluid therein), the workpiece 146 is positioned at the die cutting station 120 by a predetermined increment of rotation of the turntable 92 by the drive and control assemblies 128, 132. The die cutting station 120 generally separates each of the envelopes 420 from remaining portions of the workpiece 146. One punch press 336 which may be incorporated at the die cutting station 120 is illustrated in FIG. 16 and generally includes a reciprocal punch plate 340 with an appropriately configured cutting die 344 positioned thereon. More particularly,the cutting die 344 preferably cuts through the upper and lower layers 152, 148 about each of the envelopes 420. For instance, a die cut 328 is illustrated on the workpiece 310 of FIG. 15. One such punch press is the Model D which is commercially available from H. Schwabe Inc. of Brooklyn N.Y. The Model D is described in detail in the instruction/operating manual provided therewith. As can be appreciated, since the die cut is positioned substantially close to the envelopes (e.g., FIG. 15), the positioning of the workpiece 146 in its predetermined position on/relative to the turntable 92 must again continue to be maintained in the noted manner such that the envelopes 420 are not pierced by the die which provides for the desired separation.

Figure 16A:
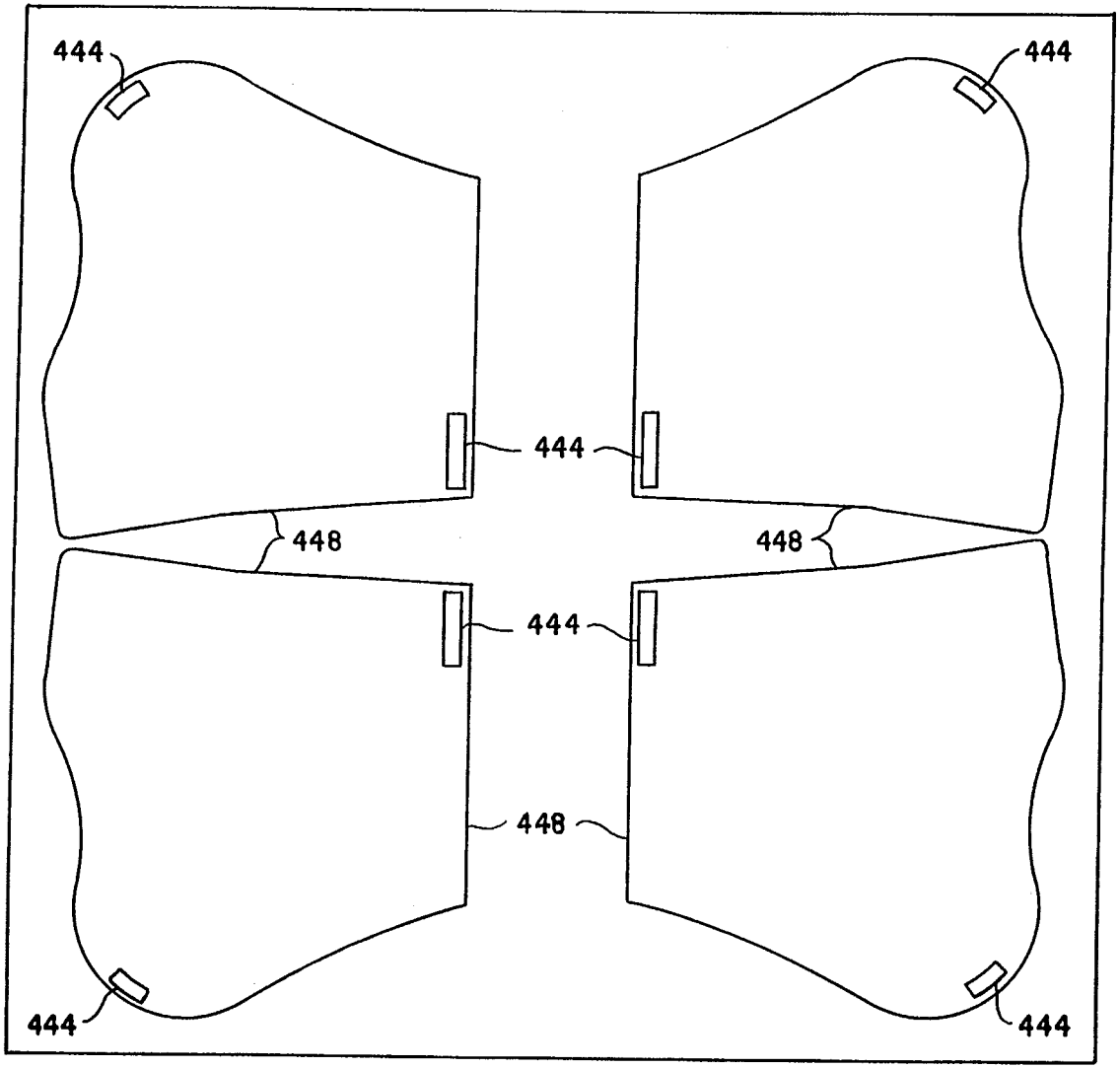
FIG. 16A is one embodiment of a workpiece subjected to a combined spout sealing station and die cutting station.

As an alternative to utilizing a separate spout sealing station 116 and die cutting station 120, it may be desirable to incorporate these stations together at a single station. For instance, referring to FIG. 16A, an appropriately configured die (not shown) may be attached to an appropriate RF sealer. The die would include electrode configured and positioned thereon to provide a seal 444 at each of the inlets 312 and vents 324 of the envelopes 312. The die would also includes electrodes configured and positioned thereon to provide a die cut 448 about the edge of each envelope 312. More particularly, the cutting about the perimeters of the envelopes 312 may be provided by the application of RF energy at the spout sealing station such that the sealing of the inlets 320 and vents 324, as well as the cutting about the perimeter of each of the envelopes 312, is provided substantially simultaneously. This combination of the spout sealing and die cutting stations may of course be applicable to all configurations of envelopes formable by the present invention, including the envelopes 420.

Once the envelopes 420 are separated from remaining portions of the workpiece 146, the turntable 92 positions the workpiece 146 at the stripping station 124 where the envelopes 420 may be removed from the buffer material 140, as well as remaining portions of the workpiece 146 which are typically disposed of as scrap. The buffer material 140 may thereafter be cleaned for reuse (e.g., wiping off excess fluid thereon) and the above-described process may be completed at this particular work station on the turntable 92. Moreover, if required the male fill tool may be removed and cleaned by removal of such from the turntable 92.

Notwithstanding the sequence of the processing stations presented with regard to the envelope forming assembly 88, it can be appreciated that for some types of envelopes, a different sequence may be appropriate. Moreover, it can be appreciated that various other types of supports for the workpiece 146 may be utilized versus the turntable 92. For instance, it may be possible for a shuttle plate (not shown) to provide the function of transporting the workpiece 146 to the various stations. Moreover, it may be possible to utilize a pallet and conveyor assembly as illustrated in FIG. 17.

Figure 17:
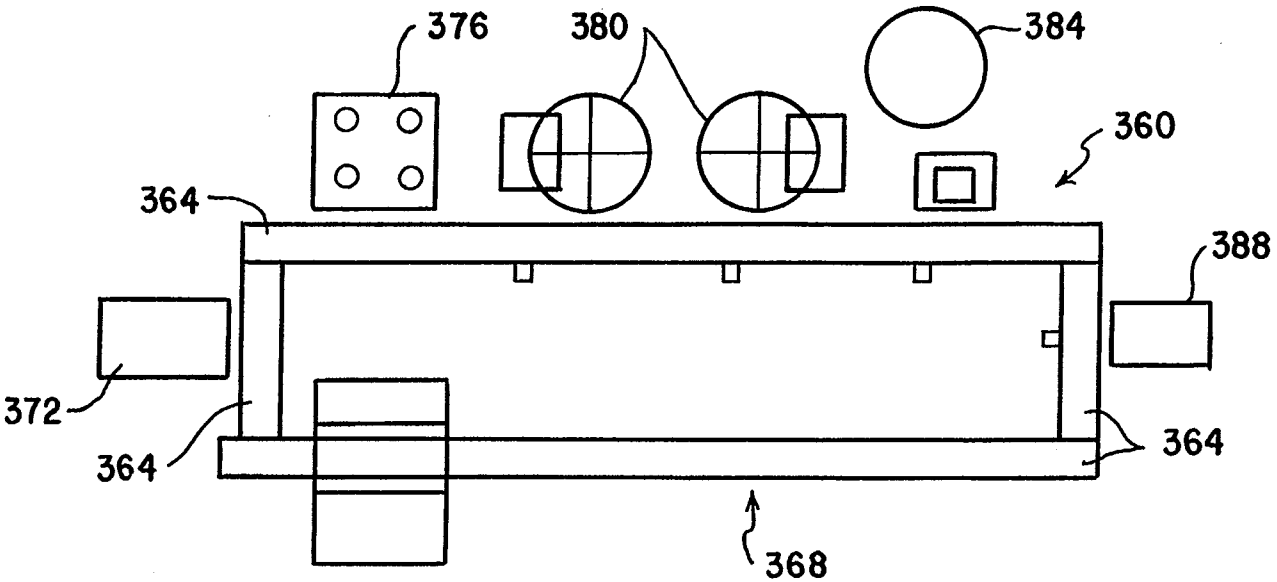
FIG. 17 is one embodiment of an envelope forming assembly.

An envelope forming assembly 360 is illustrated in FIG. 17 and provides an alternative configuration to that discussed above with regard to the envelope forming assembly 88. Generally, the envelope forming assembly 360 includes a loading station 368, a primary sealing station 372, a die cutting station 376, a velcro attachment station 380 to attach velcro to the envelope being formed (e.g., the wheelchair padding device 68 of FIG. 3), a filling/forming station 384 and a spout sealing station 388. Each of these stations may be functionally similar to corresponding stations of the assembly 88.

Figure 18:
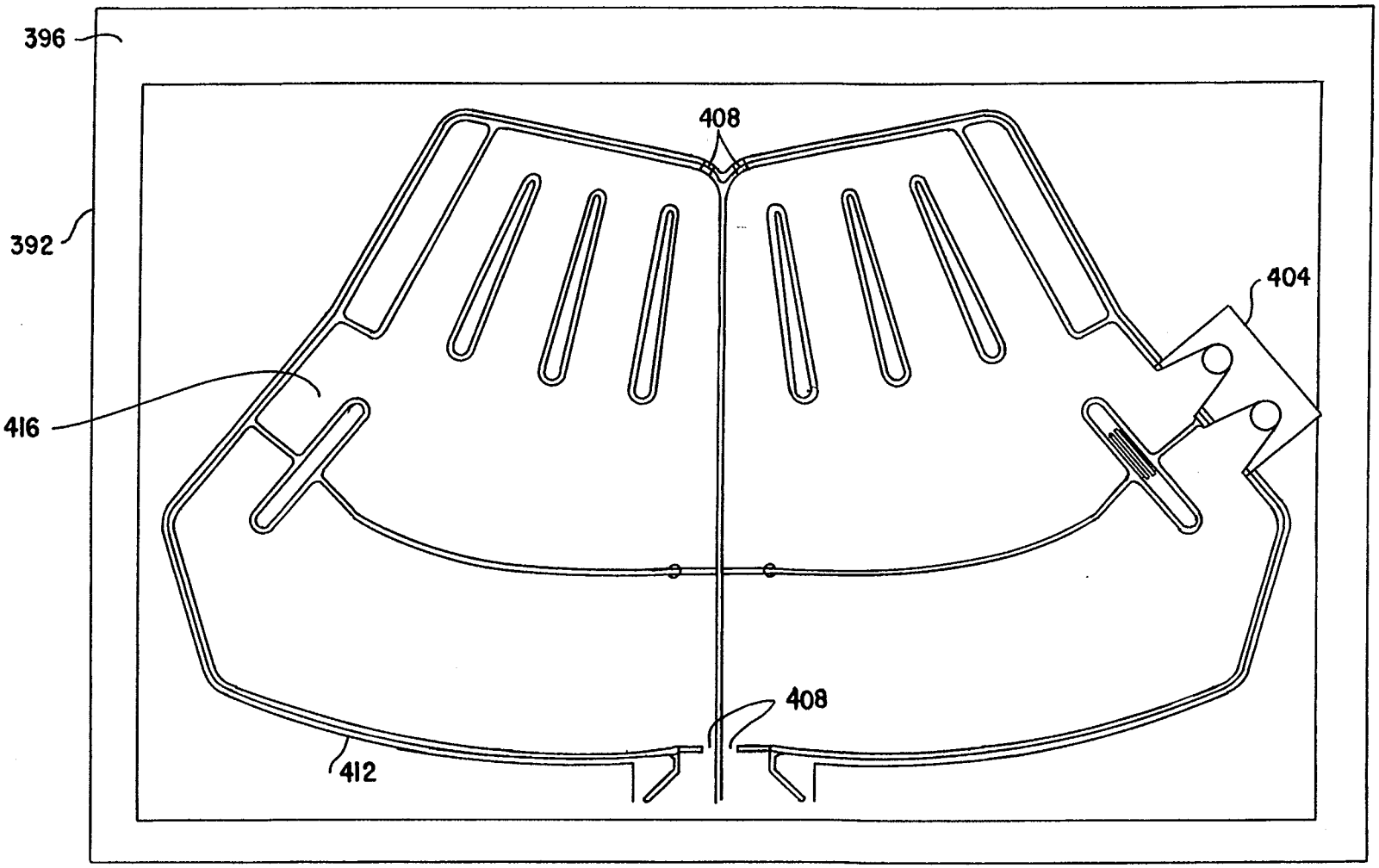
FIG. 18 is a plan view of one embodiment of a pallet with one embodiment of a workpiece positioned thereon for use in the assembly of FIG. 17.

In the configuration of the assembly 360, a pallet supports a workpiece in a manner similar to the turntable 92 discussed above such that the pallet may be positioned on the conveyor assembly 364 and transported to the various processing stations. A pallet 396 which may be used with the envelope forming assembly 360 of FIG. 17 is more particularly illustrated in FIG. 18. A buffer material 400 similar to the buffer material 140 discussed above is appropriately attached to the pallet 396 and a bottom layer with a top layer 416 superimposed thereon are positioned over the buffer material 400. When the pallet 396 is positioned at the primary sealing station 372, the bottom layer is releasably adhered to the buffer material 400 to maintain the workpiece 392 in a fixed position on the pallet 396 to provide the above-noted types of advantages. In addition, the seals are provided as well as the vents 408 and inlet ports. When the pallet 396 is positioned at the die cutting station 376, a die cut 412 is formed on the workpiece 392. Furthermore, when the pallet 396 is positioned at the filling/forming station 384, an appropriate fluid may be provided to the envelope, such as through injection nozzles 404 positioned at various locations (e.g., on one or more sides of the envelope, on the top of the envelope). Consequently, it can be appreciated that the fixed orientation of the workpiece relative to the pallet 396 is similar to that discussed above with regard to the workpiece 146 on/relative to the turntable 92.

The foregoing description of the present invention has been presented for purposes of illustration and description. However, the description is not intended to limit the invention to the form disclosed herein. Consequently, variations and modifications, commensurate with the above teachings, and the skill and/or knowledge of the relevant art, are within the scope of the present invention. The embodiments described hereinabove are further intended to explain best modes known of practicing the invention and to enable others skilled in the art to utilize the invention in such, or other embodiments and with the various modifications required by the particular applications or uses of the invention. It is intended that the appended claims be construed to include alternative embodiments to the extent permitted by the prior art.

What is claimed is:

1. A multiple station assembly for producing at least one enclosure from at least one section of material to provide at least partially superimposed first and second layers, said at least one enclosure having a fluid retained therein, said assembly comprising:

a support for said at least one section of material, wherein said first layer is positionable between said support and said second layer;

first means for positioning said support at a first station, wherein a first means for joining joins said first and second layers together to define at least a portion of a perimeter of said at least one enclosure;

means for maintaining at least a portion of each of said first and second layers in a predetermined position on said support, wherein said first means for joining comprises said means for maintaining; and second means for positioning said support at a second station in a predetermined position, said second station comprising means for introducing a fluid between said first and second layers, wherein said fluid is introduced while said at least a portion of said first and second layers is maintained in said predetermined position on said support.

2. An assembly, as claimed in claim 1, wherein:

said support comprises a rotatable turntable and said first and second means for positioning comprises means for rotatably driving said turntable in predetermined increments.

3. An assembly, as claimed in claim 1, wherein:

said support comprises a pallet and said first and second means for positioning comprises a conveyor assembly and means for installing and removing said pallet from said conveyor assembly.

4. An assembly, as claimed in claim 1, wherein:

said first means for joining defines a substantial portion of said perimeter of said at least one enclosure and at least one inlet to said at least one enclosure, said means for introducing being fluidly interconnectable with said at least one inlet.

5. An assembly, as claimed in claim 1, further comprising:

a buffer material positioned between said first layer and said support.

6. An assembly, as claimed in claim 5, wherein:

said first means for joining at least partially and detachably adheres said first layer to said buffer material.

7. An assembly, as claimed in claim 5, wherein:

a portion of said support which interfaces with said buffer material is substantially planar.

8. An assembly, as claimed in claim 1, wherein:

said means for introducing comprises a male fill tool and a pump, said male fill tool having a first portion positioned at least partially within an opening in each of said first layer and said support and a second portion positioned between said first and second layers, said first portion being fluidly interconnectable with said pump and said second portion being fluidly interconnectable with said at least one enclosure.

9. An assembly, as claimed in claim 8, wherein:

a plurality of enclosures are formed from said at least one section of material and each of said enclosures is positioned substantially equidistantly from a central axis of said male fill tool.

10. An assembly, as claimed in claim 8, wherein:

a plurality of enclosures are formed from said at least one section of material and wherein said assembly further comprises a female fill tool having a cavity for receiving said second section of said male fill tool and a concave channel for separately interconnecting each said enclosure and said male fill tool, wherein said female fill tool is forced against said second section such that said fluid flowing through said male fill tool is directed between said first and second layers in a region corresponding to each said channel to provide said fluid to said enclosure interconnected therewith.

11. An assembly, as claimed in claim 10, wherein:

said male fill tool includes an aperture for each said channel, each said aperture being fluidly connected with said first portion of said male fill tool.

12. An assembly, as claimed in claim 10, wherein:

each said enclosure is positioned substantially equidistantly from a central axis of said male fill tool and each said channel is of substantially the same length.

13. An assembly, as claimed in claim 10, wherein:

said female fill tool further comprises an enclosure cavity for each said enclosure, whereby when said female fill tool is forced against said second section said enclosure cavities will each substantially contain one of said enclosures and said second layer will substantially conform to a contour of each said enclosure cavity when said fluid is provided to each said enclosure to define at least a portion of a profile of said associated enclosure.

14. An assembly, as claimed in claim 1, further comprising:

a fill spacer positionable above said second layer to limit expansion of said at least one enclosure relative to said support, wherein a distance between said fill spacer and said support is adjustable.

15. An assembly, as claimed in claim 4, further comprising:

third means for moving said support to a third station, said third station comprising a second means for joining said first and second layers at said at least one inlet to said at least one enclosure, wherein said at least a portion of said first and second layers is maintained in said predetermined position on said support.

16. An assembly, as claimed in claim 1, further comprising:

third means for moving said support to a third station, said third station comprising means for cutting said first and second sections about said perimeter of said at least one enclosure, wherein said at least a portion of said first and second layers is maintained in said predetermined position on said support.

17. A multiple station assembly for forming at least one envelope from at least one section of material to define at least partially superimposed first and second layers, said assembly comprising:

a support;

a buffer material attached to said support, wherein said first layer is positionable on said buffer material and said second layer is positionable on said first layer;

a plurality of processing stations for forming said at least one envelope and comprising:

a first station comprising first means for joining said first and second layers together to define at least a portion of a perimeter of said at least one enclosure, wherein portions of said first layer joined to said second layer are further detachably adhered to said buffer material; and a second station comprising means for introducing a fluid between said first and second layers to provide said fluid to said at least one enclosure; and means for positioning said support at each of said processing stations.

18. An assembly, as claimed in claim 17, wherein:

said support comprises a rotatable turntable and said means for positioning comprises means for rotatably driving said turntable in predetermined increments.

19. An assembly, as claimed in claim 17, wherein:

said support comprises a pallet and said means for positioning comprises a conveyor assembly and means for installing and removing said pallet from said conveyor assembly at each said processing station.

20. An assembly, as claimed in claim 17, wherein:

said buffer material is positioned on a substantially planar portion of said support.

21. An assembly, as claimed in claim 17, wherein:

said first means for joining positions said first and second layers on said support in a substantially fixed position, said fixed position being used to align said support with each processing station.

22. An assembly, as claimed in claim 17, wherein:

said first means for joining defines a substantial portion of said perimeter of said at least one enclosure and at least one inlet to said at least one enclosure, said means for introducing being fluidly interconnectable with said at least one inlet.

23. An assembly, as claimed in claim 22, further comprising:

third means for moving said support to a third station, said third station comprising a second means for joining said first and second layers at said at least one inlet to said at least one enclosure.

24. An assembly, as claimed in claim 17, further comprising:

third means for moving said support to a third station, said third station comprising means for cutting said first and second layers about said perimeter of said at least one enclosure.

25. An assembly, as claimed in claim 17, further comprising:

third means for moving said support to a third station, said at least one enclosure being removable from said buffer material.

26. A method for producing at least one fluid-containing enclosure from at least one section of material to provide first and second at least partially superimposed layers, comprising the steps of:

positioning said first layer on a buffer material attached to a support;

positioning said second layer on top of said first layer;

joining said first and second layers together in a predetermined pattern at a first station, said predetermined pattern defining a perimeter of said at least one enclosure and at least one inlet to said at least one enclosure;

adhering said first layer to said buffer material utilizing said joining step and while said support is at said first station to temporarily fix a position of said first and second layers on said support;

moving said support to a second station;

introducing a fluid between said first and second layers and into said at least one enclosure at said second station;

moving said support to a third station;

sealing said at least one inlet to said at least one enclosure at said third station;

cutting said first and second sections of material about said at least one enclosure; and removing said at least one enclosure from said buffer material.

27. A method, as claimed in claim 26, wherein:

each of said moving steps comprises incorporating said support on a rotatable turntable and rotating said turntable in predefined increments.

28. A method, as claimed in claim 26, wherein:

said support comprises a pallet and each said moving step comprises positioning said pallet on and removing said pallet from a conveyor assembly which is interconnected with each of said first, second, and third stations.

29. A method, as claimed in claim 26, further comprising the steps of:

moving said support to a fourth station after said sealing step, wherein said cutting step is performed at said fourth station.

30. A method, as claimed in claim 26, wherein:

said cutting step is performed at said third station and substantially simultaneously with said sealing step.

31. A multiple station assembly for producing at least one enclosure from at least one section of material to provide at least partially superimposed first and second layers, said at least one enclosure having a fluid retained therein, said assembly comprising:

a support for said at least one section of material, wherein said first layer is positionable between said support and said second layer;

first means for positioning said support at a first station, said first station comprising first means for joining said first and second layers together to define a substantial portion of a perimeter of said at least one enclosure and at least one inlet to said at least one enclosure;

means for maintaining at least a portion of each of said first and second layers in a predetermined position on said support; second means for positioning said support at a second station in a predetermined position, said second station comprising means for introducing a fluid between said first and second layers which is interconnectable with said at least one inlet, wherein said fluid is introduced while said at least a portion of said first and second layers is maintained in said predetermined position on said support; and third means for moving said support to a third station, said third station comprising a second means for joining said first and second layers at said at least one inlet to said at least one enclosure, wherein said at least a portion of said first and second layers is maintained in said predetermined position on said support.

32. A multiple station assembly for producing at least one enclosure from at least one section material to provide at least partially superimposed first and second layers, said at least one enclosure having a fluid retained therein, said assembly comprising:

a support for said at least one section of material and comprising a rotatable turntable, wherein said first layer is positionable between said support and said second layer;

first means for positioning said support at a first station, said first station comprising first means for joining said first and second layers together to define at least a portion of a perimeter of said at least one enclosure;

means for maintaining at least a portion of each of said first and second layers in a predetermined position on said support; and second means for positioning and support at a second station in a predetermined position, wherein said first and second means for positioning comprises means for rotatably driving said turntable in predetermined increments, said second station comprising means for introducing a fluid between said first and second layers, wherein said fluid is introduced while said at least a portion of said first and second layers is maintained in said predetermined position on said support.

33. A multiple station assembly for producing at least one enclosure from at least one section of material to provide at least partially superimposed first and second layers, said at least one enclosure having a fluid retained therein, said assembly comprising:

a support for said at least one section of material and comprising a pallet, wherein said first layer is positionable between said support and said second layer;

first means for positioning and support at a first station, said first station comprising first means for joining said first and second layers together to define at least a portion of a perimeter of said at least one enclosure;

means for maintaining at least a portion of each of said first and second layers in a predetermined position on said support; and second means for positioning said support at a second station in a predetermined position, wherein said first and second means for positioning comprises a conveyor assembly and means for installing and removing said pallet from said conveyor assembly, said second station comprising means for introducing a fluid between said first and second layers, wherein said fluid is introduced while said at least a portion of said first and second layers is maintained in said predetermined position on said support.

34. A multiple station assembly for producing at least one enclosure from at least one section of material to provide at least partially superimposed first and second layers, said at least one enclosure having a fluid retained therein, said assembly comprising:

a support for said at least one section of material;

a buffer material, wherein said buffer material is positioned between said support and said first layer and said first layer is positionable between said buffer material and said second layer;

first means for positioning said support at a first station, said first station comprising first means for joining said first and second layers together to define at least a portion of a perimeter of said at least one enclosure;

means for maintaining at least a portion of each of said first and second layers in a predetermined position on said support, wherein said first means for joining at least partially and releasably adheres said first layer to said buffer material; and second means for positioning said support at a second station in a predetermined position, said second station comprising means for introducing a fluid between said first and second layers, wherein said fluid is introduced while said at least a portion of said first and second layers is maintained in said predetermined position on said support.

35. A multiple station assembly for producing at least one enclosure from at least one section of material to provide at least partially superimposed first and second layers, said at least one enclosure having a fluid retained therein, said assembly comprising:

a support for said at least one section of material;

a buffer material, wherein a portion of said support which interfaces with said buffer material is substantially planar and wherein said buffer material is positioned between said support and said first layer and said first layer is positionable between said buffer material and said second layer;

first means for positioning said support at a first station, said first station comprising first means for joining said first and second layers together to define at least a portion of a perimeter of said at least one enclosure;

means for maintaining at least a portion of each of said first and second layers in a predetermined position on said support; and second means for positioning said support at a second station in a predetermined position, said second station comprising means for introducing a fluid between said first and second layers, wherein said fluid is introduced while said at least a portion of said first and second layers is maintained in said predetermined position on said support.

36. A multiple station assembly for producing at least one enclosure from at least one section of material to provide at least one enclosure having a fluid retained therein, said assembly comprising:

a support for said at least one section of material, wherein said first layer is positionable between said support and said second layer;

first means for positioning said support at a first station, said first station comprising first means for joining said first and second layers together to define at least a portion of a perimeter of said at least one enclosure;

means for maintaining at least a portion of each of said first and second layers in a predetermined position on said support; and second means for positioning said support at a second station in a predetermined position, said second station comprising means for introducing a fluid between said first and second layers, wherein said fluid is introduced while said at least a portion of said first and second layers is maintained in said predetermined position on said support, said means for introducing comprising a male fill tool and a pump, said male fill tool having a first portion positioned at least partially within an opening in each of said first layer and said support and a second portion positioned between said first and second layers, said first portion being fluidly interconnectable with said pump and said second portion being fluidly interconnectable with said at least one enclosure.

37. An assembly, as claimed in claim 36, wherein:

a plurality of enclosures are formed from said at least one section of material and each of said enclosures is positioned substantially equidistantly from a central axis of said male fill tool.

38. An assembly, as claimed in claim 36, further comprising:

a female fill tool having a cavity for receiving said second section of said male fill tool and concave channel for separately interconnecting said at least one enclosure and said male fill tool, wherein said female fill tool is forced against said second section such that said fluid flowing through said male fill tool is directed between said first and second layers in a region corresponding to said channel to provide said fluid to said at least one enclosure interconnected therewith.

39. An assembly, as claimed in claim 38, wherein:

said male fill tool includes an aperture for said channel, said aperture being fluidly connected with said first portion of said male fill tool.

40. An assembly, as claimed in claim 38, wherein:

a plurality of enclosures are formed from said at least one section of material, said female fill tool further comprises a plurality of said channels whereby there is at least one said channel for each said enclosure, each said enclosure being positioned substantially equidistantly from a central axis of said male fill tool, and each said channel being of substantially the same length.

41. An assembly, as claimed in claim 38, wherein:

said female fill tool further comprises an enclosure cavity for said at least one enclosure, whereby when said female fill tool is forced against said second section said enclosure cavity will substantially contain said at least one enclosure and said second layer will substantially conform to a contour of said enclosure cavity when said fluid is provided to said at least one enclosure to define at least a portion of a profile of said at least one enclosure.

42. A multiple station assembly for producing at least one enclosure from at least one section of material to provide at least partially superimposed first and second layers, said at least one enclosure having a fluid retained therein, said assembly comprising:

a support for said at least one section of material, wherein said first layer is positionable between said support and said second layer;

first means for positioning said support at a first station, said first station comprising first means for joining said first and second layers together to define at least a portion of a perimeter of said at least one enclosure;

a fill spacer positionable above said second layer to limit expansion of said at least one enclosure relative to said support, wherein a distance between said fill spacer and said support is adjustable;

means for maintaining at least a portion of each of said first and second layers in a predetermined position on said support; and second means for positioning said support at a second station in a predetermined position, said second station comprising means for introducing a fluid between said first and second layers, wherein said fluid is introduced while said at least a portion of said first and second layers is maintained in said predetermined position on said support.

43. A multiple station assembly for producing at least one enclosure from at least one section of material to provide at least partially superimposed first and second layers, said at least one enclosure having a fluid retained therein, said assembly comprising:

a support for said at least one section of material, wherein said first layer is positionable between said support and said second layer;

first means for positioning said support at a first station, said first station comprising first means for joining said first and second layers together to define at least a portion of a perimeter of said at least one enclosure;

means for maintaining at least a portion of each of said first and second layers in a predetermined position on said support; second means for positioning said support at a second station in a predetermined position, said second station comprising means for introducing a fluid between said first and second layers, wherein said fluid is introduced while said at least a portion of said first and second layers is maintained in said predetermined position on said support; and third means for moving said support to a third station, said third station comprising means for cutting said first and second sections about said perimeter of said at least one enclosure, wherein said at least a portion of said first and second layers is maintained in said predetermined position on said support.

* * * * *